US008841610B2

(12) United States Patent
Schoen et al.

(10) Patent No.: US 8,841,610 B2
(45) Date of Patent: Sep. 23, 2014

(54) QUADRUPOLE MASS SPECTROMETER WITH ENHANCED SENSITIVITY AND MASS RESOLVING POWER

(71) Applicant: Thermo Finnigan LLC, San Jose, CA (US)

(72) Inventors: Alan E. Schoen, Saratoga, CA (US); Robert A. Grothe, Campbell, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/256,250

(22) Filed: Apr. 18, 2014

(65) Prior Publication Data

US 2014/0224980 A1 Aug. 14, 2014

Related U.S. Application Data

(63) Continuation of application No. 13/784,497, filed on Mar. 4, 2013, now Pat. No. 8,704,163, which is a continuation of application No. 12/716,138, filed on Mar. 2, 2010, now Pat. No. 8,389,929.

(51) Int. Cl.
*H01J 49/42* (2006.01)
*H01J 49/00* (2006.01)

(52) U.S. Cl.
CPC ..... *H01J 49/4215* (2013.01); *H01J 49/0031* (2013.01)
USPC ..... 250/282

(58) Field of Classification Search
USPC ..... 250/282, 281
See application file for complete search history.

(56) References Cited

U.S. PATENT DOCUMENTS

| | | | | |
|---|---|---|---|---|
| 4,810,882 | A | 3/1989 | Bateman | |
| 5,175,430 | A | 12/1992 | Enke et al. | |
| 5,644,128 | A | 7/1997 | Wollnik et al. | |
| 5,719,392 | A | 2/1998 | Franzen | |
| 6,661,013 | B2 | 12/2003 | Jagutzki et al. | |
| 7,019,307 | B1 | 3/2006 | Gribb et al. | |
| 7,339,521 | B2 | 3/2008 | Scheidemann et al. | |
| 7,470,901 | B2 | 12/2008 | Page et al. | |
| 2014/0097329 | A1 * | 4/2014 | Wadsworth | 250/208.1 |

* cited by examiner

*Primary Examiner* — Kiet T Nguyen
(74) *Attorney, Agent, or Firm* — Charles B. Katz; Michael C. Staggs

(57) ABSTRACT

A novel method and mass spectrometer apparatus is introduced to spatially and temporally resolve images of one or more ion exit patterns of a multipole instrument. In particular, the methods and structures of the present invention measures the ion current as a function of time and spatial displacement in the beam cross-section of a quadrupole mass filter via an arrayed detector. The linearity of the detected quadrupole ion current in combination with it reproducible spatial-temporal structure enables the deconvolution of the contributions of signals from individual ion species in complex mixtures where both sensitivity and mass resolving power are essential.

9 Claims, 9 Drawing Sheets

QUADRUPOLE MASS SPECTROMETER WITH ENHANCED SENSITIVITY AND MASS RESOLVING POWER

CROSS-REFERENCE TO RELATED APPLICATIONS

The present application is a continuation under 35 U.S.C. §120 and claims the priority benefit of co-pending U.S. patent application Ser. No. 13/784,497, filed Mar. 4, 2013, which is a continuation under 35 U.S.C. §120 of U.S. patent application Ser. No. 12/716,138, filed Mar. 2, 2010, now U.S. Pat. No. 8,389,929. The disclosure of each of the foregoing applications is incorporated herein by reference in its entirety.

BACKGROUND OF THE INVENTION

1. Field of the Invention

The present invention relates to the field of mass spectrometry. More particularly, the present invention relates to a mass spectrometer system and method that provides for improved high mass resolving power (MRP) and sensitivity via deconvolution of the spatial and temporal characteristics collected at the exit aperture of a quadrupole instrument.

2. Discussion of the Related Art

Quadrupoles are conventionally described as low resolution instruments. The theory and operation of conventional quadrupole mass spectrometers is described in numerous text books (e.g., Dawson P. H. (1976), *Quadrupole Mass Spectrometry and Its Applications*, Elsevier, Amsterdam), and in numerous Patents, such as, U.S. Pat. No. 2,939,952, entitled "Apparatus For Separating Charged Particles Of Different Specific Charges," to Paul et al, filed Dec. 21, 1954, issued Jun. 7, 1960.

As a mass filter, such instruments operate by setting stability limits via applied RF and DC potentials that are capable of being ramped as a function of time such that ions with a specific range of mass-to-charge ratios have stable trajectories throughout the device. In particular, by applying fixed and/or ramped AC and DC voltages to configured cylindrical but more often hyperbolic electrode rod pairs in a manner known to those skilled in the art, desired electrical fields are set-up to stabilize the motion of predetermined ions in the x and y dimensions. As a result, the applied electrical field in the x-axis stabilizes the trajectory of heavier ions, whereas the lighter ions have unstable trajectories. By contrast, the electrical field in the y-axis stabilizes the trajectories of lighter ions, whereas the heavier ions have unstable trajectories. The range of masses that have stable trajectories in the quadrupole and thus arrive at a detector placed at the exit cross section of the quadrupole rod set is defined by the mass stability limits.

Typically, quadrupole mass spectrometry systems employ a single detector to record the arrival of ions at the exit cross section of the quadrupole rod set as a function of time. By varying the mass stability limits monotonically in time, the mass-to-charge ratio of an ion can be (approximately) determined from its arrival time at the detector. In a conventional quadrupole mass spectrometer, the uncertainty in estimating of the mass-to-charge ratio from its arrival time corresponds to the width between the mass stability limits. This uncertainty can be reduced by narrowing the mass stability limits, i.e. operating the quadrupole as a narrow-band filter. In this mode, the mass resolving power of the quadrupole is enhanced as ions outside the narrow band of "stable" masses crash into the rods rather than passing through to the detector. However, the improved mass resolving power comes at the expense of sensitivity. In particular, when the stability limits are narrow, even "stable" masses are only marginally stable, and thus, only a relatively small fraction of these reach the detector.

Background information on a system and method that utilizes a mathematical deconvolution process to analyze spatial characteristics provided by an arrayed source, is described and claimed in, U.S. Pat. No. 7,339,521, entitled, "ANALYTICAL INSTRUMENTS USING A PSEUDORANDOM ARRAY OF SOURCES, SUCH AS A MICRO-MACHINED MASS SPECTROMETER OR MONOCHROMATOR," issued Mar. 4, 2008, to Scheidemann et al., including the following, "Novel methods and structures are disclosed herein which employ pseudorandom sequences to spatially arrange multiple sources in a pseudorandom source array. The pseudorandom source array can replace the single source in analytical instruments relying on spatial separation of the sample or the probe particles/waves emitted by the sources. The large number of sources in this pseudorandom source array enhances the signal on a position sensitive detector. A mathematical deconvolution process retrieves a spectrum with improved signal-to-noise ratio from the detector signal."

Background information for a mass spectrometer system that provides for spatial detection of ions via a photo-emissive device, is described and claimed in, U.S. Pat. No. 4,810,882, entitled, "MASS SPECTROMETER FOR POSITIVE AND NEGATIVE IONS," issued Mar. 7, 1989, to Bateman et al., including the following, "[t]he invention provides a mass spectrometer capable of detecting both positive and negative ions. Positive ions emerging from the mass analyzer strike a conversion electrode to release secondary electrons which pass through an annular electrode to strike a phosphor, releasing photons. Negative ions strike the surface of the annular electrode to release secondary electrons which also strike the phosphor, releasing photons. The photons are detected with a conventional photomultiplier. The electrodes are biased and disposed so that both positive ions and negative ions may be detected without changing the potentials applied to them."

Background information for a system that uses an arrayed detector for ion collection is described in, "From the Infrared to X-ray: Advanced Detectors Set to Revolutionize Spectroscopy," presented Mar. 8, 2009 at Pittcon by Bonner Denton, including the following, "[w]hole new generations of highly promising ion and electron detectors are being implemented by adapting and modifying a combination of technologies originally developed for visible CCD's and infrared multiplexer arrays. This new generation of ion and electron detectors is being implemented in configurations ranging from a single element suitable for quadrupole and time-of-flight ion mobility instruments to linear arrays for ion cycloidal and sector-based mass spectrometers. The latest results using these new techniques to read micro Faraday cups and arrays of finger electrodes will be presented. Since this approach is a high-sensitivity Faraday type coulombic detector, it is suitable for implementing high-density arrays in isotope ratio spectrometers and conventional mass spectrometers, as well as ultra high-sensitivity detectors for ion mobility spectrometers." While the described detectors in the presentation provide information about the exit positions of ions, the described research does not make use of this information. Rather, the array is used to improve the total number of ions captured and is functionally equivalent to a single detector with enhanced sensitivity.

FIG. 1A shows example data from a conventional Triple Stage Quadrupole (TSQ) mass analyzer to illustrate mass resolving power capabilities presently available in a quadrupole device. As shown in FIG. 1A, the mass resolving power that results from the example detected m/z 508.208 ion is about 44, 170, which is similar to what is typically achieved in "high resolution" platforms, such as, Fourier Transform Mass Spectrometry (FTMS). To obtain such a mass resolving power, the instrument is scanned slowly and operated within the boundaries of a predetermined mass stability region. Although the mass resolving power (i.e., the intrinsic mass resolving power) shown by the data is relatively high, the sensitivity, while not shown, is very poor for the instrument.

FIG. 1B (see inset) shows Q3 intensities of example m/z 182, 508, and 997 ions from a TSQ quadrupole operated with a narrow stability transmission window (data denoted as A) and with a wider stability transmission window (data denoted as A'). The data in FIG. 1B is utilized to show that the sensitivity for a mass selectivity quadrupole can be increased significantly by opening the transmission stability window. However, while not explicitly shown in the figure, the intrinsic mass resolving power for a quadrupole instrument operated in such a wide-band mode often is undesirable.

The key point to be taken by FIGS. 1A and 1B is that conventionally, operation of a quadrupole mass filter provides for either relatively high mass resolving power or high sensitivity at the expense of mass resolving power but not for both simultaneously and in all cases, the scan rate is relatively slow. The present invention, however, provides for a system and method of operation that simultaneously provides for both a high mass resolving power and an increased sensitivity at higher scan rates, which exceeds current capabilities of quadrupole mass analyzers.

Accordingly, there is a need in the field of mass spectrometry to improve the mass resolving power of such systems without the loss in signal-to-noise ratio (i.e., sensitivity). The present invention addresses this need, as disclosed herein, by measuring the ion current as a function of both time and spatial displacement in the beam cross-section and then deconvolving the contributions of the signals from the individual ion species.

SUMMARY OF THE INVENTION

The present invention is directed to a novel quadrupole mass filter method and system that discriminates among ion species, even when both are simultaneously stable, by recording where the ions strike a position-sensitive detector as a function of the applied RF and DC fields. When the arrival times and positions are binned, the data can be thought of as a series of ion images. Each observed ion image is essentially the superposition of component images, one for each distinct m/z value exiting the quadrupole at a given time instant. Because the present invention provides for the prediction of an arbitrary ion image as a function of m/z and the applied field, each individual component can be extracted from a sequence of observed ion images by the mathematical deconvolution processes discussed herein. The mass-to-charge ratio and abundance of each species necessarily follow directly from the deconvolution.

A first aspect of the present invention is directed to a high mass resolving power high sensitivity mass spectrometer instrument that includes a multipole configured to pass an abundance of one or more ion species within stability boundaries defined by the applied RF and DC fields, which are characterized by the unitless Mathieu parameters (a,q); a detector configured to record the spatial and temporal properties of the abundance of ions at a cross-sectional area of the multipole; and a processing means configured to subject said recorded spatial and temporal properties of said abundance of one or more species of ions as a function of the applied RF and/or DC fields to deconvolution so as to provide mass discrimination of said one or more ion species.

Another aspect of the present invention provides for a deconvolution process of acquired images from a mass analyzer and detector by first acquiring or synthetically generating a reference signal. The reference signal is a series of images, where each image represents the spatial distribution of exiting ions of a single (canonical) species produced by a particular state of the fields applied to the quadrupole. Thereafter the process is designed to acquire spatial and temporal raw data of an abundance of one or more ion species from an exit channel of said multipole. It then generates a shifted autocorrelation vector from the reference signals and breaks the acquired data into suitable chunks and pads such data with zeros. The dot product of one of more chunks of data with each of the reference signals is then generated. The deconvolution problem is then put into a matrix form, often in Toeplitz form, so as to solve and thus provide mass discrimination of said abundance of one or more ion species to include: the number of distinct ion species and, for each species, accurate estimates of its relative abundance and mass-to-charge ratio.

Accordingly, the present invention provides for an apparatus and method of operation that enables a user to acquire comprehensive mass data with a time resolution on the order of about an RF cycle by computing the distribution of the ion density not only as a function of the applied fields but also as a function of position in the spatial cross section at a quadrupole exit. Applications include, but are not strictly limited to: petroleum analysis, drug analysis, phosphopeptide analysis, DNA and protein sequencing, etc. that hereinbefore were not capable of being interrogated with quadrupole systems. As side benefits, such configurations and methods disclosed herein enable relaxed requirements on the manufacturing tolerances, which reduces overall cost while improving robustness.

DETAILED DESCRIPTION

Figure 1B:
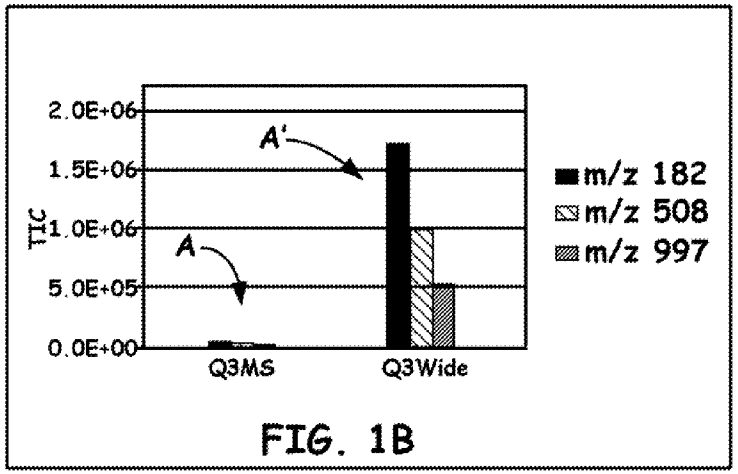
FIG. 1B shows additional Q3 data from a TSQ quadrupole operated with an AMU stability transmission window of 0.7 FWHM in comparison with an AMU stability transmission window of 10.0 FWHM.
Figure 1A:
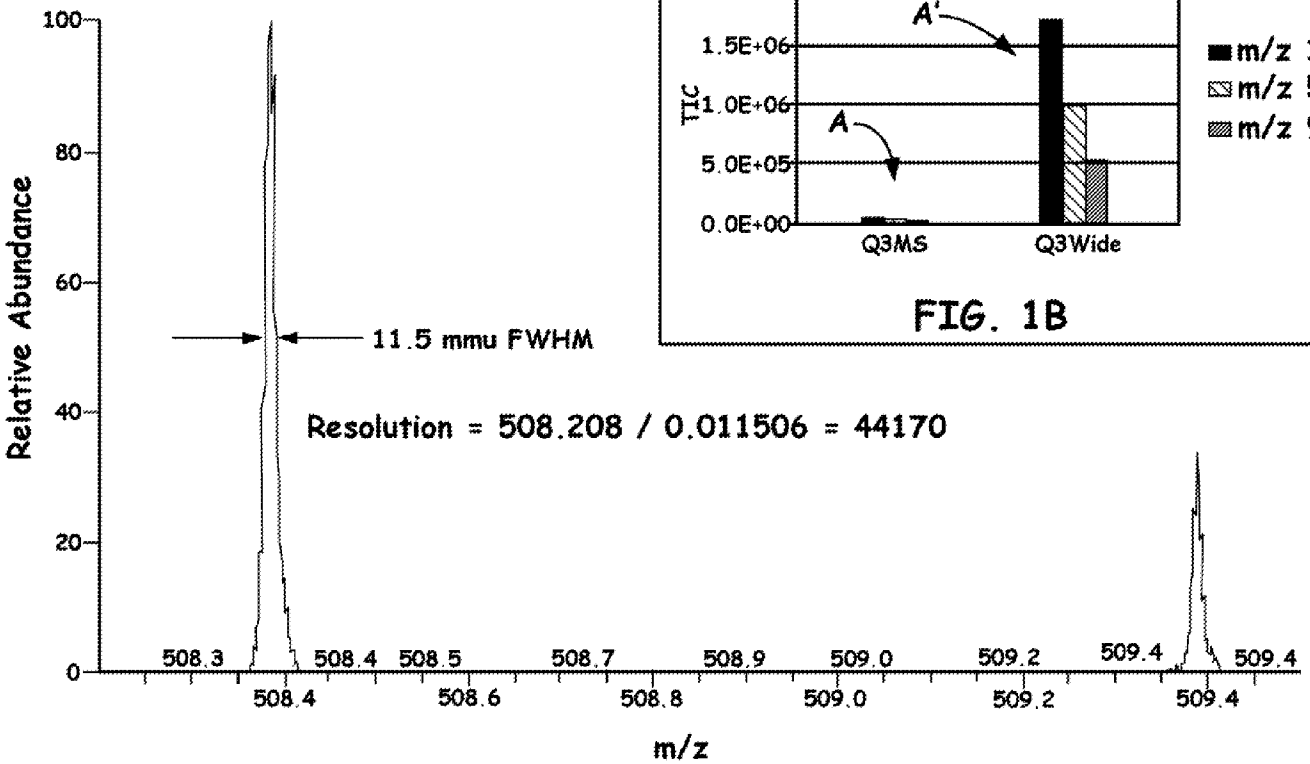
FIG. 1A shows example quadrupole mass data from a beneficial commercial TSQ.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise. In addition, unless otherwise indicated, numbers expressing quantities of ingredients, constituents, reaction conditions and so forth used in the specification and claims are to be understood as being modified by the term "about."

Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

General Description

Typically, a multipole mass filter (e.g., a quadrupole mass filter) operates on a continuous ion beam although pulsed ion beams may also be used with appropriate modification of the scan function and data acquisition algorithms to properly integrate such discontinuous signals. A quadrupole field is produced within the instrument by dynamically applying electrical potentials on configured parallel rods arranged with four-fold symmetry about a long axis. The axis of symmetry is referred to as the z-axis. By convention, the four rods are described as a pair of x rods and a pair of y rods. At any instant of time, the two x rods have the same potential as each other, as do the two y rods. The potential on the y rods is inverted with respect to the x rods. Relative to the constant potential at the z-axis, the potential on each set of rods can be expressed as a constant DC offset plus an RF component that oscillates rapidly (with a typical frequency of about 1 MHz).

The DC offset on the x-rods is positive so that a positive ion feels a restoring force that tends to keep it near the z-axis; the potential in the x-direction is like a well. Conversely, the DC offset on the y-rods is negative so that a positive ion feels a repulsive force that drives it further away from the z-axis; the potential in the y-direction is like a saddle.

An oscillatory RF component is applied to both pairs of rods. The RF phase on the x-rods is the same and differs by 180 degrees from the phase on the y-rods. Ions move inertially along the z-axis from the entrance of the quadrupole to a detector often placed at the exit of the quadrupole. Inside the quadrupole, ions have trajectories that are separable in the x and y directions. In the x-direction, the applied RF field carries ions with the smallest mass-to-charge ratios out of the potential well and into the rods. Ions with sufficiently high mass-to-charge ratios remain trapped in the well and have stable trajectories in the x-direction; the applied field in the x-direction acts as a high-pass mass filter. Conversely, in the y-direction, only the lightest ions are stabilized by the applied RF field, which overcomes the tendency of the applied DC to pull them into the rods. Thus, the applied field in the y-direction acts as a low-pass mass filter. Ions that have both stable component trajectories in both x and y pass through the quadrupole to reach the detector. The DC offset and RF amplitude can be chosen so that only ions with a desired range of m/z values are measured. If the RF and DC voltages are fixed, the ions traverse the quadrupole from the entrance to the exit and exhibit exit patterns that are a periodic function of the containing RF phase. Although where the ions exit is based upon the separable motion, the observed ion oscillations are completely locked to the RF. As a result of operating a quadrupole in, for example, a mass filter mode, the scanning of the device by providing ramped RF and DC voltages naturally varies the spatial characteristics with time as observed at the exit aperture of the instrument.

The present invention exploits such varying characteristics by collecting the spatially dispersed ions of different m/z even as they exit the quadrupole at essentially the same time. For example, as exemplified in FIG. 2B, at a given instant in time, the ions of mass A and the ions of mass B can lie in two distinct clusters in the exit cross section of the instrument. The present invention acquires the dispersed exiting ions with a time resolution on the order of 10 RF cycles, more often down to an RF cycle (e.g., a typical RF cycle of 1 MHz corresponds to a time frame of about 1 microsecond) or with sub RF cycle specificity to provide data in the form of one or more collected images as a function of the RF phase at each RF and/or applied DC voltage. Once collected, the present invention can extract the full mass spectral content in the captured image(s) via a constructed model that deconvolutes the ion exit patterns and thus provide desired ion signal intensities even while in the proximity of interfering signals.

In composition, the quadrupole mass spectrometer of the present invention differs from a conventional quadrupole mass-spectrometer in that the present invention includes a high speed, position-sensitive detector for observing ions as they exit the quadrupole, while the latter merely counts ions without recording the relative positions of the ions. In particular, the present invention differs from a conventional instrument in two important respects: 1) a mathematical transformation that converts a time series of ion images into a mass spectrum and 2) a quadrupole configured to operate with wide stability limits, producing high sensitivity. Unlike conventional quadrupole instruments, wider stability limits when utilized herein do not lead to reduced mass resolving power. In fact, the present invention produces very high mass resolving power under a wide variety of operating conditions, a property not usually associated with quadrupole mass spectrometers.

Accordingly, the novel data acquisition and data analysis apparatus and methods disclosed herein form the basis of the present invention, allowing it to simultaneously achieve higher sensitivity and mass resolving power (MRP) at higher scan rates than is possible in conventional systems. A time series of ion images is acquired at a high temporal sampling rate while the applied DC offset and RF amplitude are ramped. A deconvolution algorithm reconstructs the distribution of ion mass-to-charge ratio values that reach the detector, providing a "mass spectrum", actually a mass-to-charge ratio spectrum. Given the high data rate and computational requirements of the present invention, a graphics processing unit (GPU) is often used to convert the data stream into mass spectra in real time.

Specific Description

The trajectory of ions in an ideal quadrupole is modeled by the Mathieu equation. The Mathieu equation describes a field of infinite extent both radially and axially, unlike the real situation in which the rods have a finite length and finite separation. The solutions of the Mathieu equation, as known to those skilled in the art, can be classified as bounded and non-bounded. Bounded solutions correspond to trajectories that never leave a cylinder of finite radius, where the radius depends on the ion's initial conditions. Typically, bounded solutions are equated with trajectories that carry the ion through the quadrupole to the detector. For finite rods, some ions with bounded trajectories hit the rods rather than passing through to the detector, i.e., the bound radius exceeds the radius of the quadrupole orifice. Conversely, some ions with marginally unbounded trajectories pass through the quadrupole to the detector, i.e., the ion reaches the detector before it has a chance to expand radially out to infinity. Despite these shortcomings, the Mathieu equation is still very useful for understanding the behavior of ions in a finite quadrupole, such as that used in the present invention.

The Mathieu equation can be expressed in terms of two unitless parameters, a and q. The general solution of the Mathieu equation, i.e., whether or not an ion has a stable trajectory, depends only upon these two parameters. The trajectory for a particular ion also depends on a set of initial conditions—the ion's position and velocity as it enters the quadrupole and the RF phase of the quadrupole at that instant. If m/z denotes the ion's mass-to-charge ratio, U denotes the DC offset, and V denotes the RF amplitude, then a is proportional to U/(m/z) and q is proportional to V/(m/z). The plane of (q, a) values can be partitioned into contiguous regions corresponding to bounded solutions and unbounded solutions. The depiction of the bounded and unbounded regions in the q-a plane is called a stability diagram, as is to be discussed in detail below with respect to FIG. 2A. The region containing bounded solutions of the Mathieu equation is called a stability region. A stability region is formed by the intersection of two regions, corresponding to regions where the x- and y-components of the trajectory are stable respectively. There are multiple stability regions, but conventional instruments involve the principal stability region. The principal stability region has a vertex at the origin of the q-a plane. Its boundary rises monotonically to an apex at a point with approximate coordinates (0.706, 0.237) and falls monotonically to form a third vertex on the a-axis at q approximately 0.908. By convention, only the positive quadrant of the q-a plane is considered. In this quadrant, the stability region resembles a triangle.

Figure 2A:
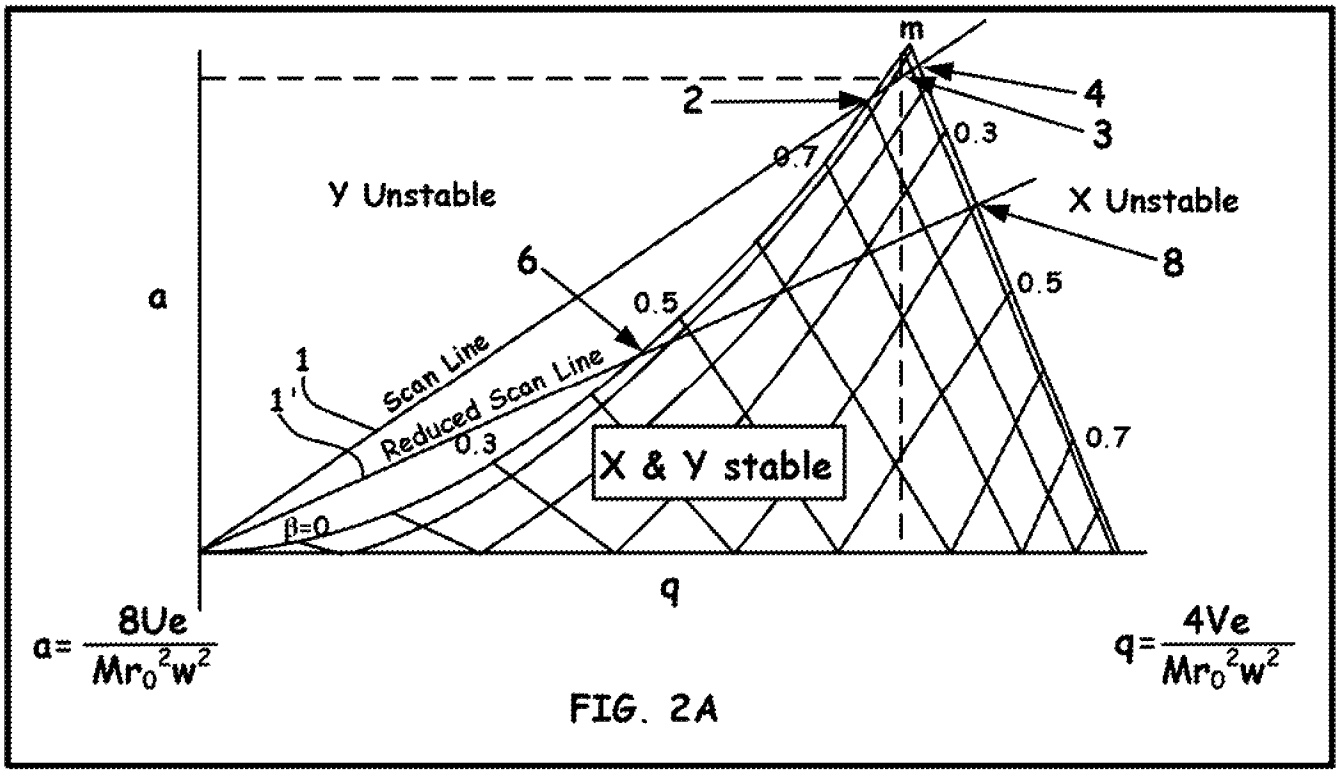
FIG. 2A shows the Mathieu stability diagram with a scan line representing narrower mass stability limits and a "reduced" scan line, in which the DC/RF ratio has been reduced to provide wider mass stability limits.

FIG. 2A shows such an example Mathieu quadrupole stability diagram for ions of a particular mass/charge ratio. For an ion to pass, it must be stable in both the X and Y dimensions simultaneously. The Y iso-beta lines ($\beta_y$), as shown in FIG. 2A, tend toward zero at the tip of the stability diagram and the X iso-beta lines ($\beta_x$) tend toward 1.0. During common operation of a quadrupole for mass filtering purposes, the q and a parameters for corresponding fixed RF and DC values, can be desirably chosen to correspond close to the apex (denoted by m) in the diagram "parked" so that substantially only m ions can be transmitted and detected. For other values of U/V ratios, ions with different m/z values map onto a line in the stability diagram passing through the origin and a second point (q*,a*) (denoted by the reference character 2). The set of values, called the operating line, as denoted by the reference character 1 shown in FIG. 2A, can be denoted by {(kq*, ka*): k>0), with k inversely proportional to m/z. The slope of the line is specified by the U/V ratio. When q and a and thus proportional applied RF and DC voltages to a quadrupole are increased at a constant ratio, the scan line 1 is configured to pass through a given stability region for an ion.

Therefore, the instrument, using the stability diagram as a guide can be "parked", i.e., operated with a fixed U and V to target a particular ion of interest, (e.g., at the apex of FIG. 2A as denoted by m) or "scanned", increasing both U and V amplitude monotonically to bring the entire range of m/z values into the stability region at successive time intervals, from low m/z to high m/z. A special case is when U and V are each ramped linearly in time. In this case, all ions progress the same fixed operating line through the stability diagram, with ions moving along the line at a rate inversely proportional to m/z. For example, if an ion of mass-to-charge ratio M passes through (q*,a*) 2 at time t, an ion with mass-to-charge 2M passes through the same point at time 2t. If (q*,a*) 2 is placed just below the tip of the stability diagram of FIG. 2A, so that mass-to-charge M is targeted at time t, then mass-to-charge ratio 2M is targeted at time 2t. Therefore, the time scale and m/z scale are linearly related. As a result, the flux of ions hitting the detector as a function of time is very nearly proportional to the mass distribution of ions in a beam. That is, the detected signal is a "mass spectrum".

To provide increased sensitivity by increasing the abundance of ions reaching the detector, the scan line 1', as shown in FIG. 2A, can be reconfigured with a reduced slope, as bounded by the regions 6 and 8. When the RF and DC voltages are ramped linearly with time, ("scanned" as stated above) every m/z value follows the same path in the Mathieu stability diagram (i.e., the q, a path) with the ions, as before, moving along the line at a rate inversely proportional to m/z.

To further appreciate ion movement with respect to the Mathieu stability diagram, it is known that an ion is unstable in the y-direction before entering the stability region but as the ion enters a first boundary 2 of the stability diagram (having a $\beta_y$=0), it becomes critically stable, with relatively large oscillations of high amplitude and low frequency in the y-direction that tend to decrease over time. As the ion exits the stability diagram as shown by the boundary region 4, it becomes unstable in the x-direction ($\beta_x$=1), and so the oscillations in the x-direction tend to increase over time, with relatively large oscillations in x just before exiting. If the scan line is operated in either the y-unstable region or the x-unstable region, ions not bounded within the stability diagram discharge against the electrodes and are not detected. Generally, if two ions are stable at the same time, the heavier one (entering the stability diagram later) has larger y-oscillations and the lighter one has larger x-oscillations.

The other aspect of ion motion that changes as the ion moves through the stability region of FIG. 2A is the frequency of oscillations in the x- and y-directions (as characterized by the Mathieu parameter beta (β)). As the ion enters the stability diagram, the frequency of its (fundamental) oscillation in the y-direction is essentially zero and rises to some exit value. The fundamental y-direction ion frequency increases like a "chirp", i.e., having a frequency increasing slightly non-linearly with time as beta increases non-linearly with the a:q ramp, as is well known in the art. Similarly, the frequency (ω)

of the fundamental x-direction oscillation also increases from some initial value slightly below the RF/2 or (ω/2) up to exactly the ω/2 (β=1) at the exit. It is to be appreciated that the ion's motion in the x-direction is dominated by the sum of two different oscillations with frequencies just above and below the main (ω/2). The one just below ω/2 (i.e., the fundamental) is the minor image of the one just above ω/2. The two frequencies meet just as the ion exits, which results in a very low frequency beating phenomenon just before the ion exits, analogous to the low frequency y-oscillations as the ion enters the stability region.

Thus, if two ions are stable at the same time, the heavier one (not as far through the stability diagram) has slower oscillations in both X and Y (slightly in X, but significantly so in Y); with the lighter one having faster oscillations and has low-frequency beats in the X-direction if it is near the exit. The frequencies and amplitudes of micromotions also change in related ways that are not easy to summarize concisely, but also help to provide mass discrimination. This complex pattern of motion is utilized in a novel fashion by the present invention to distinguish two ions with very similar mass.

Figure 2B:
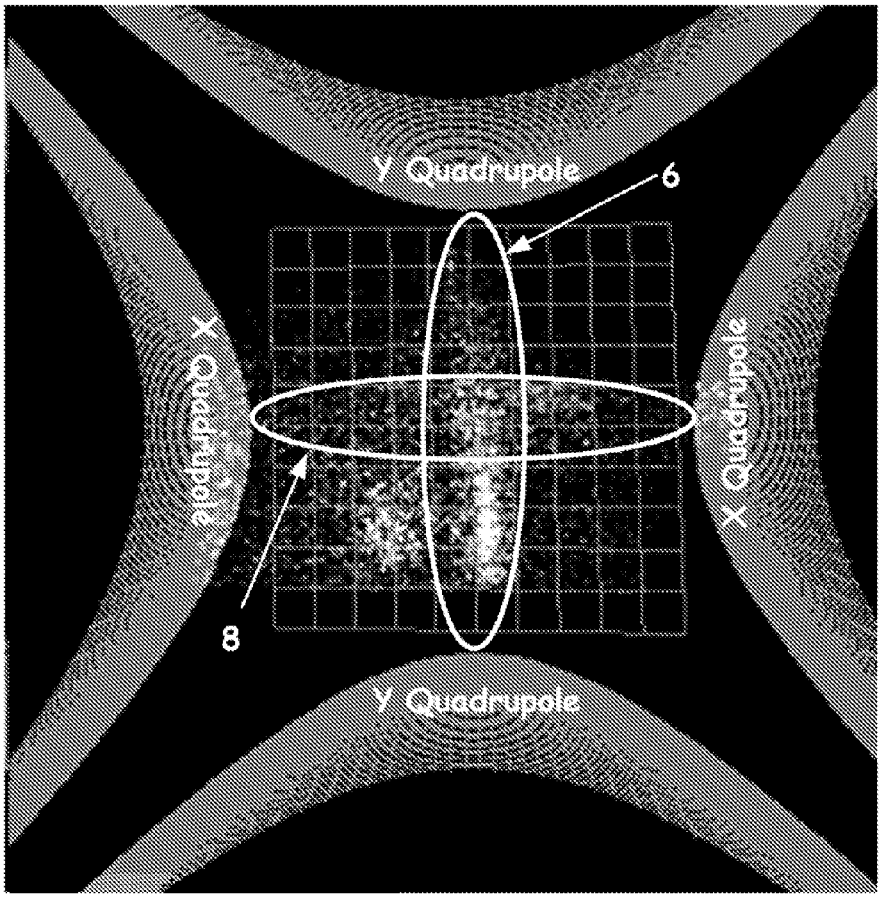
FIG. 2B shows a simulated recorded image of a multiple distinct species of ions as collected at the exit aperture of a quadrupole at a particular instant in time.

As a general statement of the above description, ions manipulated by a quadrupole are induced to perform an oscillatory motion "an ion dance" on the detector cross section as it passes through the stability region. Every ion does exactly the same dance, at the same "a" and "q" values, just at different RF and DC voltages at different times. The ion motion (i.e., for a cloud of ions of the same m/z but with various initial displacements and velocities) is completely characterized by a and q by influencing the position and shape cloud of ions exiting the quadrupole as a function of time. For two masses that are almost identical, the speed of their respective dances is essentially the same and can be approximately related by a time shift FIG. 2B shows a simulated recorded image of a particular pattern at a particular instant in time of such an "ion dance". The example image can be collected by a fast detector, (i.e., a detector capable of time resolution of 10 RF cycles, more often down to an RF cycle or with sub RF cycles specificity) as discussed herein, positioned to acquire where and when ions exit and with substantial mass resolving power to distinguish fine detail. As stated above, when an ion, at its (q, a) position, enters the stability region during a scan, the y-component of its trajectory changes from "unstable" to "stable". Watching an ion image formed in the exit cross section progress in time, the ion cloud is elongated and undergoes wild vertical oscillations that carry it beyond the top and bottom of a collected image. Gradually, the exit cloud contracts, and the amplitude of the y-component oscillations decreases. If the cloud is sufficiently compact upon entering the quadrupole, the entire cloud remains in the image, i.e. 100% transmission efficiency, during the complete oscillation cycle when the ion is well within the stability region.

As the ion approaches the exit of the stability region, a similar effect happens, but in reverse and involving the x-component rather than y. The cloud gradually elongates in the horizontal direction and the oscillations in this direction increase in magnitude until the cloud is carried across the left and right boundaries of the image. Eventually, both the oscillations and the length of the cloud increase until the transmission decreases to zero.

FIG. 2B graphically illustrates such a result. Specifically, FIG. 2B shows five masses (two shown highlighted graphically within ellipses) with stable trajectories through the quadrupole. However, at the same RF and DC voltages, each comprises a different a and q and therefore 'beta' so at every instant, a different exit pattern. The graphically provided ellipses 12 and 14 correspond to masses bounded at the edge of the stability regions 6 and 8 with respect to an example scan line (e.g., scan line 1' of FIG. 2A).

In particular, the vertical cloud of ions, as enclosed graphically by the ellipse 6 shown in FIG. 2B, correspond to the heavier ions entering the stability diagram, as described above, and accordingly oscillate with an amplitude that brings such heavy ions close to the denoted Y quadrupoles. The cluster of ions enclosed graphically by the ellipse 8 shown in FIG. 2B correspond to lighter ions exiting the stability diagram, as also described above, and thus cause such ions to oscillate with an amplitude that brings such lighter ions close to the denoted X quadrupoles. Within the image lie the additional clusters of ions (shown in FIG. 2B but not specifically highlighted) that have been collected at the same time frame but which have a different exit pattern because of the differences of their a and q and thus 'beta' parameters.

Every exit cloud of ions thus performs the same "dance", oscillating wildly in y as it enters the stability region and appears in the image, settling down, and then oscillating wildly in x as it exits the stability diagram and disappears from the image. Even though all ions do the same dance, the timing and the tempo vary. The time when each ion begins its dance, i.e. enters the stability region, and the rate of the dance, are scaled by $(m/z)^{-1}$.

Accordingly, because it is possible to construct a time-series of ion images for an ion with arbitrary m/z, it is also possible to extract each individual component from a sequence of observed ion images similar to that shown in FIG. 2B by the mathematical deconvolution process detailed herein. The mass-to-charge ratio and abundance of each species follow directly from the deconvolution. It is to be noted that while ions injected symmetrically along the axis of a quadrupole provide for distinction as imaged at the exit aperture of a quadrupole device, it is preferable that ions be injected off-center to provide for even greater distinctions as collected at the exit aperture due to the exit ion cloud undergoing even larger oscillations. FIG. 2B illustrates such an off-center injection embodiment.

A key point is that merely classifying ion trajectories as bounded versus unbounded does not harness the full potential of a quadrupole to distinguish ions with similar mass-to-charge ratios. Finer distinctions can be made among ions with bounded trajectories by collecting ion images that record where ions fall on the detector as a function of the applied fields. Each observed ion image is the superposition of component images, one for each distinct m/z value exiting the quadrupole at a given time instant. The present invention demonstrates the ability to distinguish the m/z values of ions that are simultaneously stable in the quadrupole by recording the times and positions where ions hit the detector. Leveraging this ability, the present invention has a profound impact upon the sensitivity of a quadrupole mass spectrometer. Because only ions with bounded trajectories are measured, it necessarily follows that the signal-to-noise characteristic of any ion species improves with the number of ions that actually reach the detector.

The stability transmission window for the quadrupole in the present invention can thus be configured in a predetermined manner (i.e., by reducing the slope of the scan line 1', as shown in FIG. 2A) to allow a relatively broad range of ions to pass through the instrument, the result of which increases the signal-to-noise because the number of ions recorded for a given species is increased. Accordingly, by increasing the number of ions, a gain in sensitivity is beneficially provided because at a given instant of time a larger fraction of a given species of ions can now not only pass through the quadrupole but also pass through the quadrupole for a much longer duration of the scan. The potential gain in sensitivity necessarily follows by the multiplicative product of these factors.

However, while the increase in ion counts is necessary, there are certain tradeoffs that may be required for increased sensitivity. As an example, when a quadrupole is operated as a mass-filter with improved ion statistics, i.e., by opening the transmission stability window, a gain in sensitivity can be negated by a loss in mass resolving power because the low-abundance species within the window may be obscured by one of higher abundance that is exiting the quadrupole in the same time frame. To mitigate such an effect, it is to be appreciated that while the mass resolving power of the present invention is potentially substantially large (i.e., by operating with RF-only mode), often the system of the present invention is operated with a mass resolving power window of up to about 10 AMU wide and in some applications, up to about 20 AMU in width in combination with scan rates necessary to provide for useful signal to noise ratios within the chosen m/z transmission window.

Using ion images as a basis for separation enables the methods and instruments of the present invention to provide not only high sensitivity, (i.e., an increased sensitivity 10 to 200 times greater than a conventional quadrupole filter) but to also simultaneously provide for differentiation of mass deltas of 100 ppm (a mass resolving power of 10 thousand) down to about 10 ppm (a mass resolving power of 100 thousand). Unexpectedly, the present invention can even provide for an unparalleled mass delta differentiation of 1 ppm (i.e., a mass resolving power of 1 million) if the devices disclosed herein are operated under ideal conditions that include minimal drift of all electronics.

Figure 3:
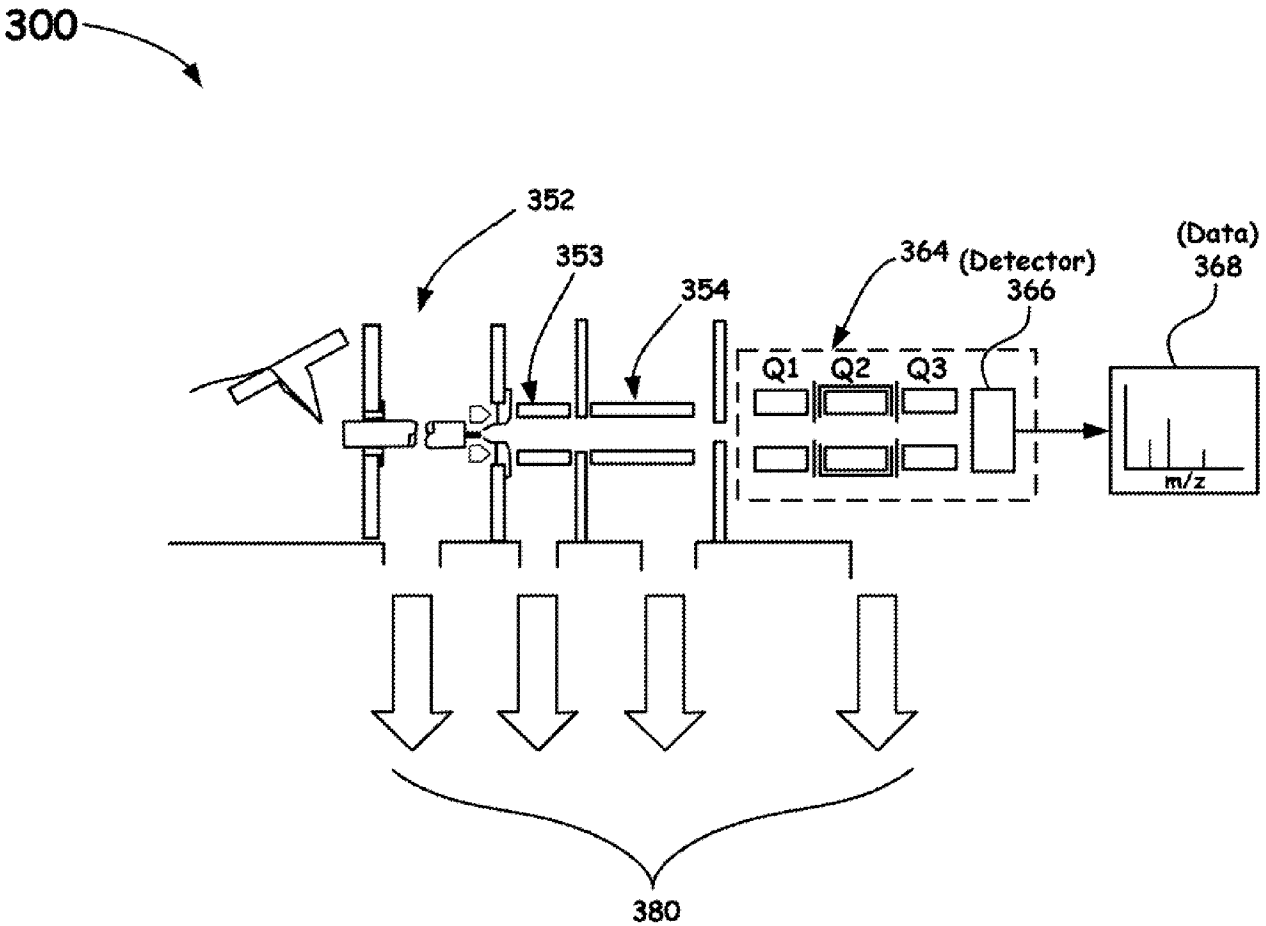
FIG. 3 shows a beneficial example configuration of a triple stage mass spectrometer system that can be operated with the methods of the present invention.

Turning back to the drawings, FIG. 3 shows a beneficial example configuration of a triple stage mass spectrometer system (e.g., a commercial TSQ), as shown generally designated by the reference numeral 300. It is to be appreciated that mass spectrometer system 300 is presented by way of a non-limiting beneficial example and thus the present invention may also be practiced in connection with other mass spectrometer systems having architectures and configurations different from those depicted herein.

The operation of mass spectrometer 300 can be controlled and data can be acquired by a control and data system (not depicted) of various circuitry of a known type, which may be implemented as any one or a combination of general or special-purpose processors (digital signal processor (DSP)), firmware, software to provide instrument control and data analysis for mass spectrometers and/or related instruments, and hardware circuitry configured to execute a set of instructions that embody the prescribed data analysis and control routines of the present invention. Such processing of the data may also include averaging, scan grouping, deconvolution as disclosed herein, library searches, data storage, and data reporting.

It is also to be appreciated that instructions to start predetermined slower or faster scans as disclosed herein, the identifying of a set of m/z values within the raw file from a corresponding scan, the merging of data, the exporting/displaying/outputting to a user of results, etc., may be executed via a data processing based system (e.g., a controller, a computer, a personal computer, etc.), which includes hardware and software logic for performing the aforementioned instructions and control functions of the mass spectrometer 300.

In addition, such instruction and control functions, as described above, can also be implemented by a mass spectrometer system 300, as shown in FIG. 3, as provided by a machine-readable medium (e.g., a computer readable medium). A computer-readable medium, in accordance with aspects of the present invention, refers to mediums known and understood by those of ordinary skill in the art, which have encoded information provided in a form that can be read (i.e., scanned/sensed) by a machine/computer and interpreted by the machine's/computer's hardware and/or software.

Thus, as mass spectral data of a given spectrum is received by a beneficial mass spectrometer 300 system disclosed herein, the information embedded in a computer program of the present invention can be utilized, for example, to extract data from the mass spectral data, which corresponds to a selected set of mass-to-charge ratios. In addition, the information embedded in a computer program of the present invention can be utilized to carry out methods for normalizing, shifting data, or extracting unwanted data from a raw file in a manner that is understood and desired by those of ordinary skill in the art.

Turning back to the example mass spectrometer 300 system of FIG. 3, a sample containing one or more analytes of interest can be ionized via an ion source 352 operating at or near invention can be operated either in the radio frequency (RF)-only mode or an RF/DC mode. Depending upon the particular applied RF and DC potentials, only ions of selected charge to mass ratios are allowed to pass through such structures with the remaining ions following unstable trajectories leading to escape from the applied multipole field. When only an RF voltage is applied between predetermined electrodes (e.g., spherical, hyperbolic, flat electrode pairs, etc.), the apparatus is operated to transmit ions in a wide-open fashion above some threshold mass. When a combination of RF and DC voltages is applied between predetermined rod pairs there is both an upper cutoff mass as well as a lower cutoff mass. As the ratio of DC to RF voltage increases, the transmission band of ion masses narrows so as to provide for mass filter operation, as known and as understood by those skilled in the art.

Accordingly, the RF and DC voltages applied to predetermined opposing electrodes of the multipole devices of the present invention, as shown in FIG. 3 (e.g., Q3), can be applied in a manner to provide for a predetermined stability transmission window designed to enable a larger transmission of ions to be directed through the instrument, collected at the exit aperture and processed so as to determined mass characteristics.

An example multipole, e.g., Q3 of FIG. 3, can thus be configured along with the collaborative components of a system 300 to provide a mass resolving power of potentially up to about 1 million with a quantitative increase of sensitivity of up to about 200 times as opposed to when utilizing typical quadrupole scanning techniques. In particular, the RF and DC voltages of such devices can be scanned over time to interrogate stability transmission windows over predetermined m/z values (e.g., 20 AMU). Thereafter, the ions having a stable trajectory reach a detector 366 capable of time resolution on the order of 10 RF cycles or atmospheric pressure or at a pressure as defined by the system requirements. Accordingly, the ion source 352 can include, but is not strictly limited to, an Electron Ionization (EI) source, a Chemical Ionization (CI) source, a Matrix-Assisted Laser Desorption Ionization (MALDI) source, an Electrospray Ionization (ESI) source, an Atmospheric Pressure Chemical Ionization (APCI) source, a Nanoelectrospray Ionization (NanoESI) source, and an Atmospheric Pressure Ionization (API), etc.

The resultant ions are directed via predetermined ion optics that often can include tube lenses, skimmers, and multipoles, e.g., reference characters 353 and 354, selected from radio-frequency RF quadrupole and octopole ion guides, etc., so as to be urged through a series of chambers of progressively reduced pressure that operationally guide and focus such ions to provide good transmission efficiencies. The various chambers communicate with corresponding ports 380 (represented as arrows in the figure) that are coupled to a set of pumps (not shown) to maintain the pressures at the desired values.

The example spectrometer 300 of FIG. 3 is shown illustrated to include a triple stage configuration 364 having sections labeled Q1, Q2 and Q3 electrically coupled to respective power supplies (not shown) so as to perform as a quadrupole ion guide that can also be operated under the presence of higher order multipole fields (e.g., an octopole field) as known to those of ordinary skill in the art. It is to be noted that such pole structures of the present more, more often down to an RF cycle or with sub RF cycles specificity, wherein the specificity is chosen to provide appropriate resolution relative to the scan rate to provide desired mass differentiation (PPM). Such a detector is beneficially placed at the channel exit of the quadrupole (e.g., Q3 of FIG. 3) to provide data that can be deconvoluted into a rich mass spectrum 368. The resulting time-dependent data resulting from such an operation is converted into a mass spectrum by applying deconvolution methods described herein that convert the collection of recorded ion arrival times and positions into a set of m/z values and relative abundances.

A simplistic configuration to observe such varying characteristics with time can be in the form of a narrow means (e.g., a pinhole) spatially configured along a plane between the exit aperture of the quadrupole (Q3) and a respective detector 366 designed to record the allowed ion information. By way of such an arrangement, the time-dependent ion current passing through the narrow aperture provides for a sample of the envelope at a given position in the beam cross section as a function of the ramped voltages Importantly, because the envelope for a given m/z value and ramp voltage is approximately the same as an envelope for a slightly different m/z value and a shifted ramp voltage, the time-dependent ion currents passing through such an example narrow aperture for two ions with slightly different m/z values are also related by a time shift, corresponding to the shift in the RF and DC voltages. The appearance of ions in the exit cross section of the quadrupole depends upon time because the RF and DC fields depend upon time. In particular, because the RF and DC fields are controlled by the user, and therefore known, the time-series of ion images can be beneficially modeled using the solution of the well-known Mathieu equation for an ion of arbitrary m/z.

However, while the utilization of a narrow aperture at a predetermined exit spatial position of a quadrupole device illustrates the basic idea, there are in effect multiple narrow aperture positions at a predetermined spatial plane at the exit aperture of a quadrupole as correlated with time, each with different detail and signal intensity. To beneficially record such information, the spatial/temporal detector 366 configurations of the present invention are in effect somewhat of a multiple pinhole array that essentially provides multiple channels of resolution to spatially record the individual shifting patterns as images that have the embedded mass content. The applied DC voltage and RF amplitude can be stepped synchronously with the RF phase to provide measurements of the ion images for arbitrary field conditions. The applied fields determine the appearance of the image for an arbitrary ion (dependent upon its m/z value) in a way that is predictable and deterministic. By changing the applied fields, the present invention can obtain information about the entire mass range of the sample.

As a side note, there are field components that can disturb the initial ion density as a function of position in the cross section at a configured quadrupole opening as well as the ions' initial velocity if left unchecked. For example, the field termination at an instrument's entrance, e.g., Q3's, often includes an axial field component that depends upon ion injection. As ions enter, the RF phase at which they enter effects the initial displacement of the entrance phase space, or of the ion's initial conditions. Because the kinetic energy and mass of the ion determines its velocity and therefore the time the ion resides in the quadrupole, this resultant time determines the shift between the ion's initial and exit RF phase. Thus, a small change in the energy alters this relationship and therefore the exit image as a function of overall RF phase. Moreover, there is an axial component to the exit field that also can perturb the image. While somewhat deleterious if left unchecked, the present invention can be configured to mitigate such components by, for example, cooling the ions in a multipole, e.g., the collision cell Q2 shown in FIG. 3, and injecting them on axis or preferably slightly off-center by phase modulating the ions within the device. The direct observation of a reference signal, i.e. a time series of images, rather than direct solution of the Mathieu equation, allows us to account for a variety of non-idealities in the field. The Mathieu equation can be used to convert a reference signal for a known m/z value into a family of reference signals for a range of m/z values. This technique provides the method with tolerance to non-idealities in the applied field.

The Effect of Ramp Speed

As discussed above, as the RF and DC amplitudes are ramped linearly in time, the a,q values for each ion each increase linearly with time, as shown above in FIG. 2A. Specifically, the ions in traversing the length of a quadrupole undergo a number of RF cycles during this changing condition and as a consequence, such ions experience a changing beta during the ramping of the applied voltages. Accordingly, the exit position for the ions after a period of time change as a function of the ramp speed in addition to other aforementioned factors. Moreover, in a conventional selective mass filter operation, the peak shape is negatively affected by ramp speed because the filter's window at unit mass resolving power shrinks substantially and the high and low mass cutoffs become smeared. A user of a conventional quadrupole system in wanting to provide selective scanning (e.g., unit mass resolving power) of a particular desired mass often configures his or her system with chosen a:q parameters and then scans at a predetermined discrete rate, e.g., a scan rate at about 500 (AMU/sec) to detect the signals.

However, while such a scan rate and even slower scan rates can also be utilized herein to increase desired signal to noise ratios, the present invention can also optionally increase the scan velocity up to about 10,000 AMU/sec and even up to about 100,000 AMU/sec as an upper limit because of the wider stability transmission windows and thus the broader range of ions that enable an increased quantitative sensitivity. Benefits of increased scan velocities include decreased measurement time frames, as well as operating the present invention in cooperation with survey scans, wherein the a:q points can be selected to extract additional information from only those regions (i.e., a target scan) where the signal exists so as to also increase the overall speed of operation.

The Detector

Figure 4:
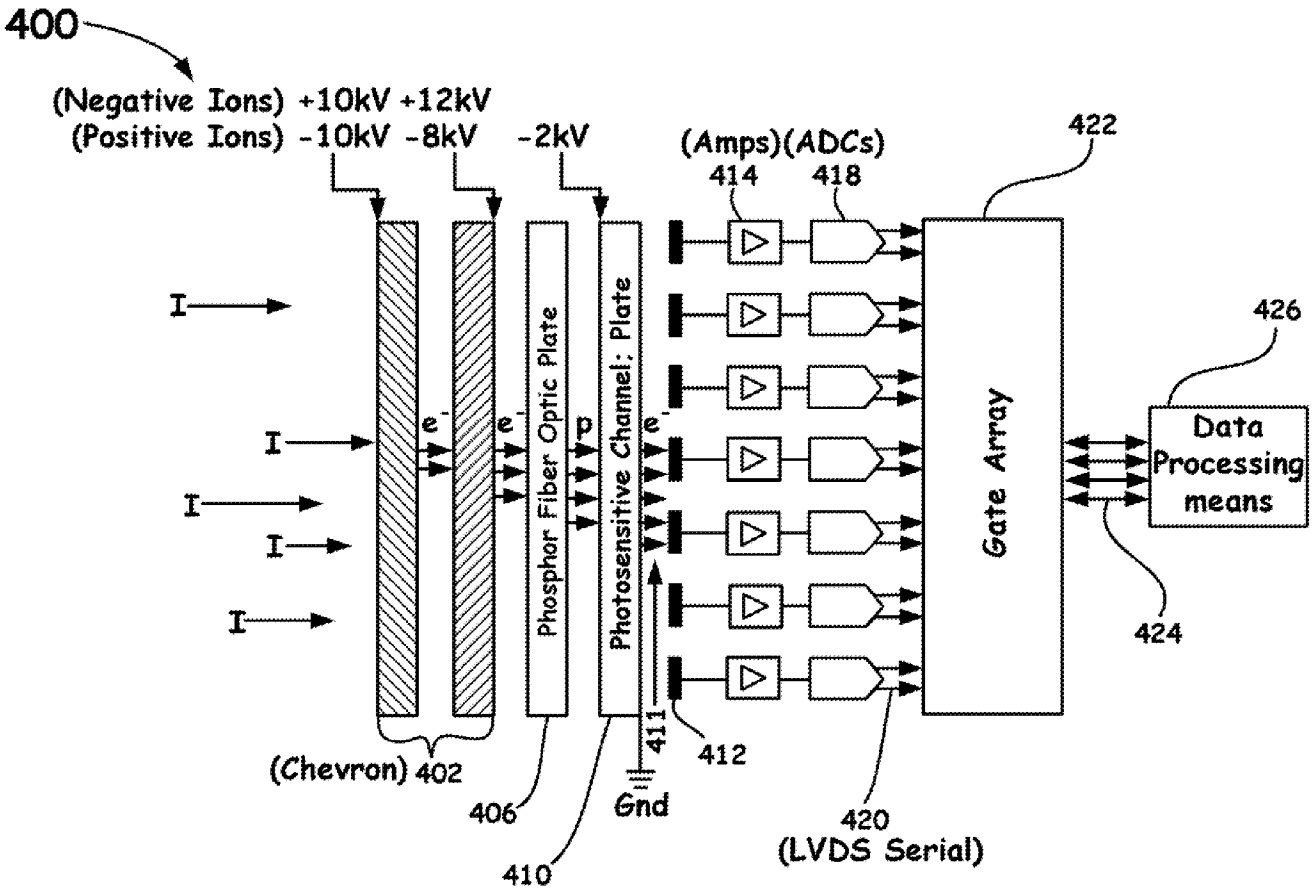
FIG. 4 shows an example embodiment of a time and position ion detector system configured with a linear array of read-out anodes.

FIG. 4 shows a basic non-limiting beneficial example embodiment of a time and position ion detector system, generally designated by the reference numeral 400 that can be used with the methods of the present invention. As shown in FIG. 4, incoming ions I (shown directionally by way of accompanying arrows) having for example a beam diameter of at least about 1 mm, are received by an assembly of micro-channel plates (MCPs) 402. Such an assembly (e.g., for pulse counting (typically pulses of <5 nsec as known to those skilled in the art) can include a pair of MCPs (a Chevron or V-stack) or triple (Z-stack) MCPs adjacent to one another with each individual plate having sufficient gain and resolution to enable operating at appropriate bandwidth requirements (e.g., at about 1 MHz up to about 100 MHz) with the combination of plates generating up to about $10^7$ or more electrons.

To illustrate operability by way of an example, the first surface of the chevron or Z-stack (MCP) 402 can be floated to 10 kV, i.e., +10 kV when configured for negative ions and −10 kV when configured to receive positive ions, with the second surface floated to +12 kV and −8 kV respectively, as shown in FIG. 4. Such a plate biasing provides for a 2 kV voltage gradient to provide the gain with a resultant output relative 8 to 12 kV relative to ground. All high voltages portions are under vacuum between about 1e-5 mBar and 1e-6 mBar with an inert gas such as, for example Argon.

The example biasing arrangement of FIG. 4 thus enables impinging ions I as received from, for example, the exit of a quadrupole, as discussed above, to induce electrons in the front surface of the MCP 402, that are thereafter directed to travel along individual channels of the MCP 402 as accelerated by the applied voltages. As known to those skilled in the art, since each channel of the MCP serves as an independent electron multiplier, the input ions I as received on the channel walls produce secondary electrons (denoted as $e^-$). This process is repeated hundreds of times by the potential gradient across both ends of the MCP stack 402 and a large number of electrons are in this way released from the output end of the MCP stack 202 to substantially enable the preservation of the pattern (image) of the particles incident on the front surface of the MCP.

Returning back to FIG. 4, the biasing arrangement also provides for the electrons multiplied by the MCP stack 402 to be further accelerated in order to strike an optical component, e.g., a phosphor coated fiber optic plate 406 configured behind the MCP stack 402. Such an arrangement converts the signal electrons to a plurality of resultant photons (denoted as p) that are proportional to the amount of received electrons. Alternatively, an optical component, such as, for example, an aluminized phosphor screen can be provided with a biasing arrangement (not shown) such that the resultant electron cloud from the MCP 402 stack can be drawn across a gap by the high voltage onto a phosphor screen where the kinetic energy of the electrons is released as light. In any arrangement, a subsequent plate, such as, a photosensitive channel plate 410 assembly (shown with the anode output biased relative to ground) can then convert each incoming resultant photon p back into a photoelectron. Each photoelectron generates a cloud of secondary electrons 411 at the back of the photosensitive channel plate 410, which spreads and impacts as one arrangement, an array of detection anodes 412, such as, but not limited to, an two-dimensional array of resistive structures, a two-dimensional delay line wedge and strip design, as well as a commercial or custom delay-line anode readout. As part of the design, the photosensitive channel plate 410 and the anodes 412 are in a sealed vacuum enclosure 413 (as denoted by the dashed vertical rectangle).

As an illustrative example of a two-dimensional anode structure to comport with the designs herein, such an array can be configured as a linear X-Y grid with the anode structure often optimally configured herein to be smaller than those further from the center since almost all ion trajectories received from the exit of a quadrupole pass through the origin and thus comprise the most signal. As an illustrative arrangement, if an Arria FPGA is utilized, a target grid of 10 radial sectors and 8 radial divisions in a spider web arrangement is desired. From such an example arrangement, the output of the anodes 412 can be configured as four symmetrical quadrants that are physically joined. If capacitance effects degrade the bandwidth of the signals, each of the anodes of FIG. 4 can be coupled to an independent amplifier 414 and additional analog to digital circuitry (ADC) 418 as known in the art. For example, such independent amplification can be by way of differential trans-impedance amplifiers to amplify and suppress noise with the ADC's 418 being provided by octal ADC's converting at less than about 500 MHz, often down to about 100 MHz, often at least about 40 MHz. If the ion entrance provided by a quadrupole is not symmetrical, then additional discrimination can be provided by an off-axis entrance orifice or by use of a cooling cell, as briefly discussed above, such as Q2 in the triple quad 364 arrangement shown in FIG. 3, so as to alter the input phase and enhance system 400 operations. In this case, joining opposite sectors is not desired.

While such an anode structure 412 shown in FIG. 4 is a beneficial embodiment, it is to also be appreciated that delay-line anodes, as stated above, of different designs (e.g., cross-wired delay-line anodes, helical grids, etc.) can also be implemented in the shown arrangement of FIG. 4, or equally arranged to be coupled adjacently following the MCP 402 stack without the additional shown components so as to also operate within the scope of the present invention. To enable the working of such devices, the structures themselves are often coupled with appropriate additional timing and amplification circuitry (e.g., trans-impedance amplifiers) matched to the anode configurations in order to aid in converting the reading of the signal differences in arrival time into image position information. Particular beneficial cross-wired delay-line anodes that can be utilized with the systems of the present invention can be found in: U.S. Pat. No. 6,661,013, entitled "DEVICE AND METHOD FOR TWO-DIMENSIONAL DETECTION OF PARTICLES OR ELECTROMAGNETIC RADIATION," to Jagutzki et al., issued Dec. 9, 2003, the disclosure of which is hereby incorporated by reference in its entirety.

Turning back to the basic anode structure of FIG. 4, the signals resultant from amplifier 414 and analog to digital circuitry (ADC) 418 and/or charge integrators (not shown) can eventually be directed to a Field Programmable Gate Array (FPGA) 422 via, for example, a serial LVDS (low-voltage differential signaling) high-speed digital interface 420, which is a component designed for low power consumption and high noise immunity for the data rates of the present invention. An FPGA 422 is beneficial because of the capability of being a configurable co-processor to a computer processing means 426, as shown in FIG. 4, allowing it to operate as an application-specific hardware accelerator for the computationally intensive tasks of the present invention. As one such example non-limiting arrangement, a commercial Arria FPGA having 84 in, 85 out LVDS I/O channels as well as integrated PCI express hardware 424 (denoted with four bidirectional arrows) having at least a ×4 channel PCI express acquisition system, feeding a standard data processing means 426 (e.g., a computer, a PC, etc.), can be utilized with a Compute Unified Device Architecture (CUDA) parallel processing Graphics Processing Unit (GPU) subsystem.

Figure 5:
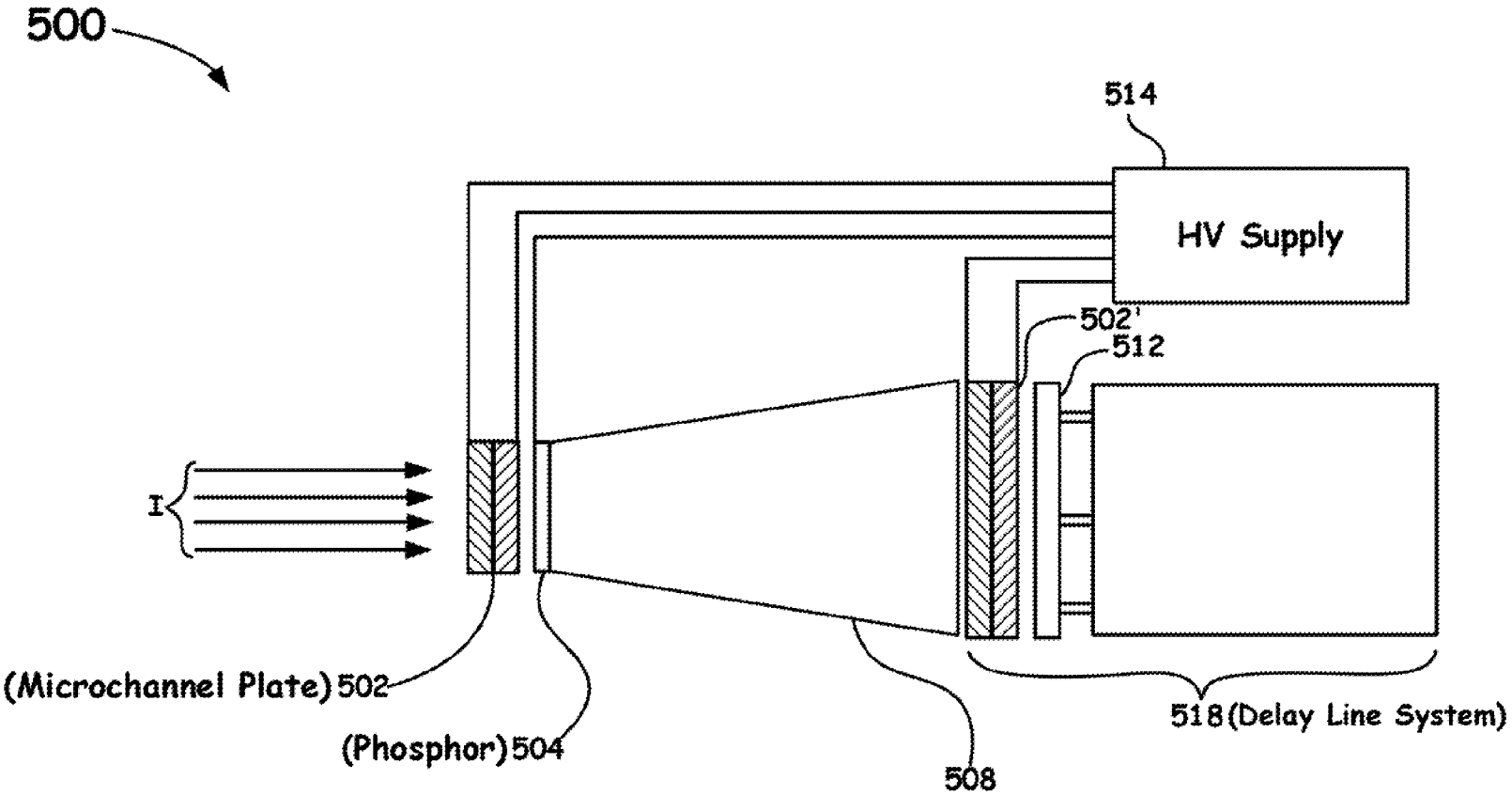
FIG. 5 shows an example time and position ion detector system that implements a delay-line system.

FIG. 5 shows another beneficial time and position ion detector system, now generally designated by the reference numeral 500 that implements a delay-line anode variation of the configurations discussed above for FIG. 4. In general, the time and position ion detector system 500 includes a front end microchannel plate (MCP) stack 502, an optical conduit 508, a delay-line detection system 518, and a high voltage supply 514 to provide necessary biasing voltages. As part of an ion to photon conversion process, desired incoming ions I (shown directionally by way of accompanying arrows) having a desired beam diameter, are received by the front end assembly of microchannel plates (MCPs) 502 (e.g., a Chevron or V-stack or a triple (Z-stack)). In this arrangement, such microchannel plates (MCPs) 502 are configured with a biasing arrangement (+10 kV to about +15 kV when configured for negative ions and −10 kV to about −15 kV when configured to receive positive ions, with the second surface floated to, for example, +12 kV and −8 kV) to again enable each individual plate to have sufficient gain for the requirements of the present invention.

To provide photon to time and position detection, an optical component, such as, but not limited to, a phosphor coated fiber optic plate 504 is configured a behind the MCP stack 502 so as to convert the signal electrons to a plurality of photons proportional to the amount of received electrons from the MCP stack 502. Thereafter, an optical conduit 508, often a tapered fiber optic bundle, is coupled to the phosphor coated fiber optic plate 504 to expand the image size up to about 80 mm (e.g., 40 mm) in at least one of the X-Y dimensions to provide a resolution that is not limited by the quadrupole device. The optical conduits, often the tapered optical conduits, can be configured from round, square, and hexagonal formats and can be fabricated in the form of almost any regularly shaped polygon.

In the configuration shown in FIG. 5, the directed photons are then received by a commercial or custom made delay-line system 518. As an example configuration to illustrate without limiting the configurations herein, the delay-line system 518 can be a commercial RoentDek delay line 3-dimensional photosensitive detector encapsulated within a sealed tube housing. Such a system is often configured with a low-noise photo-cathode (not shown) coupled to a fiber optic window (also not shown) designed to convert received photons from the optical conduit 508 into proportional electrons. Thereafter, a chevron or Z-Stack microchannel plate (MCP) 502' receives and amplifies the converted electrons and directs a resultant electron cloud to orthogonal delay-line anodes (generally shown as 512). The lead of the anodes 512 are thus coupled to a circuit board (not shown) located external to the sealed environment, wherein the circuit board can include five constant fraction discriminators (CFD) (not shown) and time to digital converters (TDC) (also not shown) designed to register up to about five precise time stamps for every single ion event as eventually provided to a PCI interface and data processing means (not shown), as discussed above. Because of the arrangement shown in FIG. 5, the ion events I are thus easily converted into a three-dimensional representation of X and Y coordinates and time of arrival for each and every ion as long as the arrival rate does not exceed the typical pulse pile-up limit for counting systems.

As similarly discussed above, different delay-line anode designs (e.g., cross-wired delay-line anodes, helical grids, etc.) can also be substituted for the anode structures 512 shown in FIG. 5, i.e., by substituting structures found in, for example, incorporated by reference U.S. Pat. No. 6,661,013. Moreover, as part of the read-out concept for MCPs advanced by Roentek, the present invention can also be configured with a delay-line read out anodes mounted outside of the sealed environment. In such an arrangement, a resistive layer of Germanium is deposited directly on the output window (glass or ceramics) of the intensifier, replacing the phosphor screen of a conventional image intensifier. The position information is obtained by a dedicated pickup delay-line electrode (anode) and coupled read-out board mounted outside the seal and in close contact to the window. The spacing between the travelling charge cloud inside the tube and the separated read-out electrode outside causes a geometrical spread of the induced signal on the read-out board. This is beneficial because it allows using rather coarse read-out structures, e.g., strips with few millimeters of pitch for the delay-line read-out.

Figure 6:
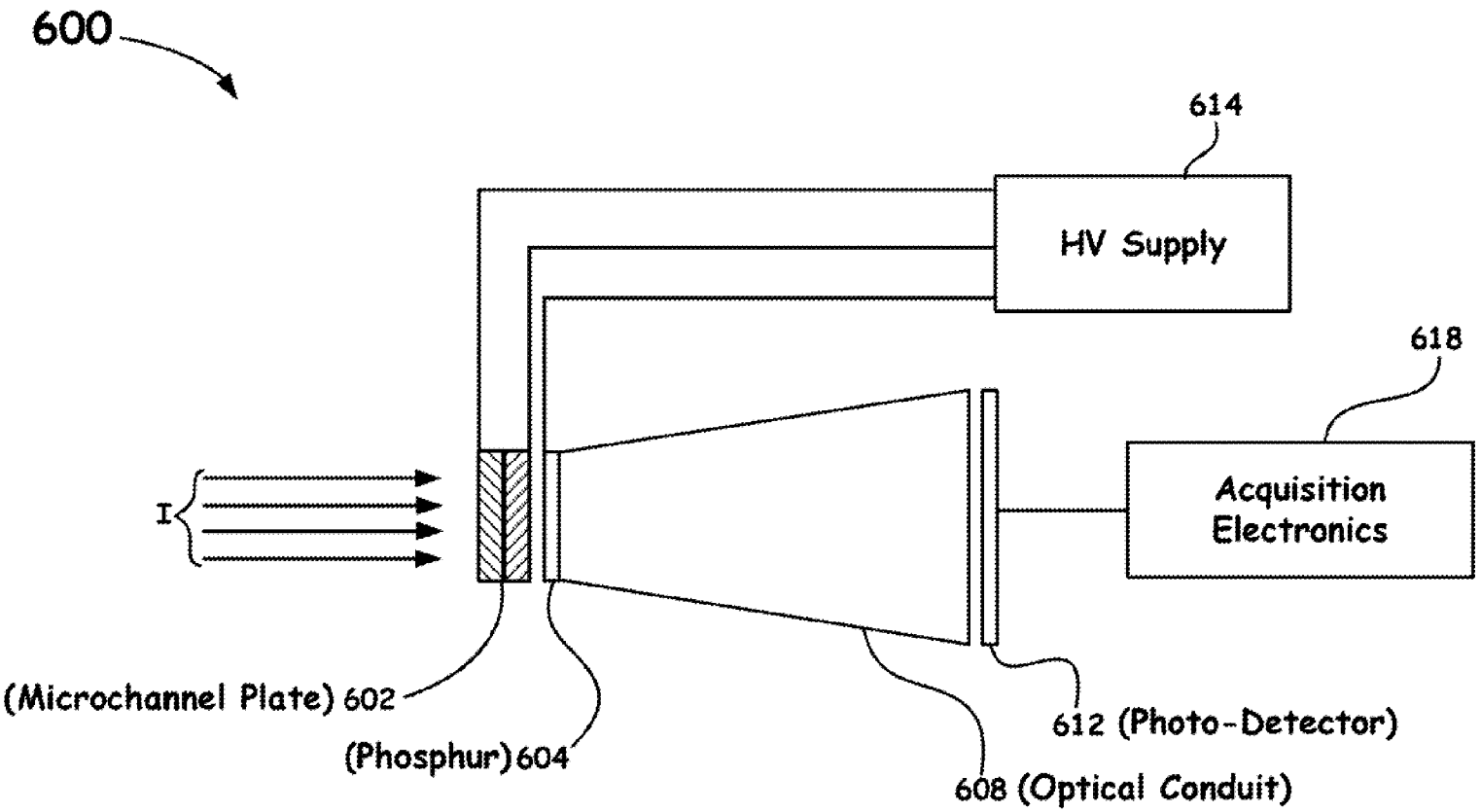
FIG. 6 shows an example time and position ion detector system that incorporates photo-detector technology.

FIG. 6 shows another desired time and position ion detector system, now generally designated by the reference numeral 600. In this configuration, the time and position ion detector system 600 also includes a front end microchannel plate (MCP) stack 602, an optical conduit 608, acquisition electronics 618, such as, but not limited to, a CPU and GPU processor similar to the configurations discussed above, and in this novel arrangement, a photo-detector 612, e.g., any of a number of 2-dimensional pixel detectors, such as, but not limited to Charge Injection Device (CID) detectors capable of being incorporated into the configurations of the present invention. With respect to a particular CID, such detectors can be configured as, but not limited to, a square array of a power of 2 pixels, e.g., 64 by 64. In an example mode of operation, all 64 pixels in each column can be read as a single readout with each read at a minimum of once per RF cycle of at least about 1.0 MHz or desirably higher so as to increase sub RF cycle specificity. In another mode of operation, each pixel in each column can be read individually. For example, all pixels of Row 1 can be read in RF cycle 1 while additional signal integration is accumulating on the other 63 rows. After 64 RF cycles, each has been read once, but not necessarily simultaneously. The reading is the integral of the accumulated signal for 64 interleaved RF cycles. In yet another example mode of operation, multiple rows can be read, for example, by 2's to get an entire read in 32 RF cycles.

Thus, desired incoming ions I (shown directionally by way of accompanying arrows) are received by the front end assembly of microchannel plates (MCPs) 602, as similarly discussed above with respect to FIG. 5. To provide the photon to time and position detection, an optical component, such as, but not limited to, a phosphor coated fiber optic plate 604 is again configured a few millimeters behind the MCP stack 602 so as to convert the signal electrons to a plurality of photons proportional to the amount of received electrons from the MCP stack 602. Thereafter, an optical conduit 608, such as, but not limited to a tapered fiber optic bundle, is coupled to the phosphor coated fiber optic plate 604 to magnify and/or minify the produced images so as to match the dimensions of the photo-detector 612, e.g., a CID. The optical conduits, as before, can be configured from round, square, and hexagonal formats and can be fabricated in the form of almost any regularly shaped polygon.

In those example situations where an increase of mass resolving power is desired, the system can be configured to provide the detected information in a manageable fashion. For example, during deconvolution, the dot product part of the algorithm, as detailed below, can be pipelined. The dot products between the observed signal and the family of reference signals can be computed on the fly by accumulating the contributions to each dot product from each pixel value as the pixel is read out. Pixel values need not be stored after their contributions to the dot products have been recorded, reducing the need for large memory buffers. Using the FPGA of FIG. 4 as an example, a 64 by 64 array can be read out as 64 rows and thus 64 columns is only 128 total readings to represent most of the unique information in the 4096 pixel array. If the acquisition rate is also lowered, multiple RF cycles can be averaged to reduce computational burden without significantly sacrificing mass resolving power. As another alternative, a multichannel analyzer can be configured with each pixel to divide the RF cycle of the quadrupole device into a number of sub-cycle bins, wherein the RF is either tracked by, as an example, the FPGA of FIG. 4 or the photo-detector of FIG. 6, or generated by it. Each sub-cycle bin can integrate signal for the desired duration and then be read out. The total data rate is therefore a continuous conversion process with all components active all of the time.

The computer processing means (not shown) within the acquisition electrons 618, as also provided in the configurations of FIG. 4 and FIG. 5, often includes a Graphics Processing Unit (GPU) which is, as known to those in the field, a processing means that can provide a level of massively parallel computation that was once only the preserve of supercomputers. As part of the configurations, the Graphics Processing Units (GPUs), as utilized herein, can be provided in a variety of forms, such as, in the form of a processor, a circuit, an application specific integrated circuit, a digital signal processor, a video card, or combinations thereof or other now known or later developed devices for graphics processing. As an example, the GPU can include a graphics processor or video card provided by ATI, Matrox, or nVIDIA using an application programming interface (API) of OpenCL and CUDA, or other now known or later developed APIs. Such a GPU utilized herein can also include one or more vertex processors and one or more fragment processors. Other analog or digital devices may also be included, such as rasterization and interpolation circuits. One or more frame buffers may also be provided for outputting data to a display.

Thus, the GPU, as coupled to the configurations described above, is beneficially utilized to receive data representing various objects with associated spatial relationships in one or more formats. Thereafter, the GPU in turn beneficially generates 2 or 3 dimensional images based on the data, such as, by performing texture mapping or other 2 or 3 dimensional rendering. The GPU is also operable to determine the relative positioning of the data and generate fragments representing data visible from a particular viewing direction. As part of GPU architecture utilized herein, such an incorporated GPU unit also includes video memory, such as for example, random access memory, configured to store desired amounts of information, i.e., 64, 128, 256 or other number of kilobytes as received from an upstream device, such as, but not limited to the FPGA 422 shown in FIG. 4. The GPU in operation thus accesses the information from the video memory for graphics processing pursuant to the application programming interface (API) as configured with the data processing means, such as a personal computer (PC).

Discussion of the Deconvolution Procedure

The deconvolution process is a numerical transformation of the image data acquired from a specific mass spectrometric analyzer (e.g., a quadrupole) and a detector. All mass spectrometry methods deliver a list of masses and the intensities of those masses. What distinguishes one method from another is how it is accomplished and the characteristics of the mass-intensity lists that are produced. Specifically, the analyzer that discriminates between masses is always limited in mass resolving power and that mass resolving power establishes the specificity and accuracy in both the masses and intensities that are reported. The term abundance sensitivity (i.e., quantitative sensitivity) is used herein to describe the ability of an analyzer to measure intensity in the proximity of an interfering species. Thus, the present invention utilizes a deconvolution process to essentially extract signal intensity in the proximity of such an interfering signal.

The instrument response to a mono-isotopic species can be described as a stacked series of two dimensional images, and that these images appear in sets that may be grouped into a three dimensional data packet described herein as voxels. Each data point is in fact a short series of images. Although there is the potential to use the pixel-to-pixel proximity of the data within the voxels, the data herein is treated as two-dimensional, with one dimension being the mass axis and the other a vector constructed from a flattened series of images describing the instrument response at a particular mass. This instrument response has a finite extent and is zero elsewhere. This extent is known as the peak width and is represented in Atomic Mass Units (AMU). In a typical quadrupole mass spectrometer this is set to one and the instrument response itself is used as the definition of the mass spectrometer's mass resolving power and specificity. Within the instrument response, however, there is additional information and the real mass resolving power limit is much higher, albeit with additional constraints related to the amount of statistical variance inherent in the acquisition of weak ion signals.

Although the instrument response is not completely uniform across the entire mass range of the system, it is constant within any locality. Therefore, there are one or more model instrument response vectors that can describe the system's response across the entire mass range. Acquired data comprises convolved instrument responses. The mathematical process of the present invention thus deconvolves the acquired data (i.e., images) to produce an accurate list of observed mass positions and intensities.

Accordingly, the deconvolution process of the present invention is beneficially applied to data acquired from a mass analyzer that often comprises a quadrupole device, which as known to those of ordinary skill in the art, has a low ion density. Because of the low ion density, the resultant ion-ion interactions are negligibly small in the device, effectively enabling each ion trajectory to be essentially independent. Moreover, because the ion current in an operating quadrupole is linear, the signal that results from a mixture of ions passing through the quadrupole is essentially equal to (N) overlapping sum of the signals produced by each ion passing through the quadrupole as received onto, for example, a detector array, as described above.

The present invention capitalizes on the above-described overlapping effect via a model of detected data as the linear combination of the known signals that can be subdivided into sequential stages:

1) to produce a mass spectrum, intensity estimation under the constraint that the N signals are superimposed by unit time shifts (e.g., a Toeplitz system); and 2) selection of a subset of the above signals with intensities significantly distinguishable from zero and subsequent refinement of their intensities to produce a mass list.

Accordingly, the following is a discussion of the deconvolution process of the one or more captured images resulting from a configured quadrupole, as performed by, for example, a coupled computer. To start, let a data vector $X=(X_1, X_2, \ldots X_J)$ denote a collection of J observed values. Let $y_j$ denote the vector of values of the independent variables corresponding to measurement $X_j$. For example, the independent variables in this application position in the exit cross section and time; so $y_j$ is a vector of three values that describe the conditions under which $X_j$ can be measured.

Theoretical Estimation of Optimal Intensities Scaling N Known Signals

In the general case for deconvoluting a linear superposition of N known signals: suppose one has N known signals $U_1, U_2, \ldots U_N$, where each signal is a vector of J components. There is a one-to-one correspondence between the J components of the data vector and the J components of each signal vector. For example, consider the nth signal vector $U_n=(U_{n1}, U_{n2}, \ldots U_{NJ})$: $U_{nj}$ represents the value of the nth signal if it were "measured" at $y_j$.

One can form a model vector S by choosing a set of intensities $I_1, I_2, \ldots I_N$, scaling each signal vector $U_1, U_2, \ldots U_N$, and adding them together as indicated by Equation 1.

$$S(I_1, I_2, \ldots I_N) = \sum_{n=1}^{N} I_n U_n \tag{1}$$

The model vector S has J components, just like each signal vector $U_1, U_2, \ldots U_N$, that are in one-to-one correspondence with the components of data vector X.

Let e denote the "error" in the approximation of X by S and then find a collection of values $I_1, I_2, \ldots I_N$ that minimizes e. The choice of e is somewhat arbitrary. As disclosed herein, one defines e as the sum of the squared differences between the components of data vector X and the components of model vector S, as shown in Equation 2.

$$e(I_1, I_2, \ldots I_N) = \sum_{j=1}^{J} (S_j(I_1, I_2, \ldots I_N) - X_j)^2 \tag{2}$$

The notation explicitly shows the dependence of the model and the error in the model upon the N chosen intensity values.

One simplifies Equation 2 by defining an intensity vector I (Equation 3), defining a difference vector Δ(Equation 4), and using an inner product operator (Equation 5).

$$I=(I_1, I_2, \ldots I_N) \tag{3}$$

$$\Delta(I_1, I_2, \ldots I_N)=S(I_1, I_2, \ldots I_N)-X \tag{4}$$

$$a \cdot b = \sum_{j=1}^{J} a_j b_j \tag{5}$$

In Equation 5, a and b are both assumed to be vectors of J components.

Using Equations 3-5, Equation 2 can be rewritten as shown in Equation 6.

$$e(I)=\Delta(I)\cdot\Delta(I) \tag{6}$$

Let I* denote the optimal value of I, i.e., the vector of intensities $I^*=(I_1^*, I_2^*, \ldots I_N^*)$ that minimizes e. Then, the first derivative of e with respect to I evaluated at I* is zero, as indicated by Equation 7.

$$\frac{\partial e}{\partial I}(I^*) = 0 \tag{7}$$

Equation 7 is shorthand for N equations, one for each intensity $I_1, I_2, \ldots I_N$.

One can use the chain-rule to evaluate the right-hand side of Equation 6: wherein the error e is a function of the difference vector Δ; Δ is a function of the model vector S; and S is a function of the intensity vector I, which contains the intensities $I_1, I_2, \ldots I_N$.

One then considers the derivative of e with respect to one of the intensities $I_m$, evaluated at (unknown) I*, where m is an arbitrary index in [1 . . . N].

$$\frac{\partial e}{\partial I_m}(I^*) = \frac{\partial}{\partial I_m}(\Delta(I)\cdot\Delta(I))\Big|_{I=I^*} = 2\frac{\partial \Delta}{\partial I_m}(I^*)\cdot\Delta(I^*) \tag{8}$$

$$\frac{\partial \Delta}{\partial I_m}(I^*) = \frac{\partial}{\partial I_m}(S(I)-X)\Big|_{I=I^*} = \frac{\partial S}{\partial I_m}(I^*) \tag{9}$$

$$\frac{\partial S}{\partial I_m}(I^*) = \frac{\partial}{\partial I_m}\left(\sum_{n=1}^{N} I_m U_n\right)\Bigg|_{I=I^*} = U_m \tag{10}$$

Now, one can use Equations 9-10 to replace $$\frac{\partial \Delta}{\partial I_m}(I^*)$$

in the right-hand side of Equation 8.

$$\frac{\partial e}{\partial I_m}(I^*) = 2U_m\cdot\Delta(I^*) \tag{11}$$

Then, one can use Equation 4 to replace Δ(I*) in the right-hand side of Equation 11.

$$\frac{\partial e}{\partial I_m}(I^*) = 2U_m\cdot(S(I^*)-X) \tag{12}$$

Setting the right-hand side of Equation 12 to zero, as specified by the optimization criterion stated in Equation 7, results in Equation 13.

$$U_m\cdot S(I^*)=U_k\cdot X \tag{13}$$

Now, one can use Equation 1 to replace S(I*) in the left-hand side of Equation 13.

$$U_m\cdot\left(\sum_{n=1}^{N} I_n^* U_n\right) = U_m\cdot X \tag{14}$$

Note that Equation 14 relates the unknown intensities $\{I_n^*\}$ to the known data vector X and the known signals $\{U_n\}$. All that remains are algebraic rearrangements that leads to an expression for the values of $\{I_n^*\}$.

One uses the linearity of the inner product to rewrite the inner product of a sum that appears on the left-hand side of Equation 14 as a sum of inner products.

$$\sum_{n=1}^{N} I_n^*(U_m \cdot U_n) = U_m \cdot X \tag{15}$$

The left-hand side of Equation 15 can be written as the product of a row vector and a column vector as shown in Equation 16.

$$\sum_{n=1}^{N} I_n^*(U_m \cdot U_n) = [\, U_m \cdot U_1 \quad U_m \cdot U_2 \quad \ldots \quad U_m \cdot U_N \,] \begin{bmatrix} I_1^* \\ I_2^* \\ \vdots \\ I_N^* \end{bmatrix} \tag{16}$$

One defines the row vector $A_m$ (Equation 17) and the scalar $a_m$ (Equation 18). Both quantities depend upon index m $$A_m = [U_m \cdot U_1 U_m \cdot U_2 \ldots U_m \cdot U_N] \tag{17}$$

$$a_m = U_m \cdot X \tag{18}$$

Using Equations 16-18, one can rewrite Equation 15 compactly.

$$A_m I^* = a_m \tag{19}$$

Equation 19 hold for each m in [1 . . . N]. We can write all N equations (in the form of Equation 15) in a column of N components.

$$\begin{bmatrix} A_1 \\ A_2 \\ \vdots \\ A_N \end{bmatrix} I^* = \begin{bmatrix} a_1 \\ a_2 \\ \vdots \\ a_N \end{bmatrix} \tag{20}$$

The column vector on the left-hand side of Equation 20 contains N row vectors, each of size N. This column of rows represents an N×N matrix that we will denote by A. One forms the matrix A by substituting 1 for m in Equation 17 and replacing $A_1$ in the first row of the column vector on the left-hand side of Equation 20. This process is repeated for indices 2 . . . N, thereby constructing an N×N matrix, whose entries are given by Equation 21.

$$A_{mn} = U_m \cdot U_n = \sum_{j=1}^{J} U_{mj} U_{nj} \tag{21}$$

As indicated by Equation 21, the matrix entry at row m, column n of matrix A is the inner product of the mth signal and the nth signal. One denotes the column vector on the right hand side of Equation 20 by a.

To summarize, the N equations are encapsulated as a single matrix equation:

$$AI = a \tag{22}$$

where the components of vector a that appears in the right-hand side of Equation 22 are defined by Equation 18.

In the trivial case, where none of the signals overlap, i.e., $A_{mn}=0$ whenever $m \neq n$, A is a diagonal matrix. In this case, the solution of the optimal intensities are given by $I_n^* = a_n / A_{nn}$, for each n in [1 . . . N]. Another special case is when the signals can be partitioned into K clusters such that $A_{mn}=0$ whenever m and n belong to distinct clusters. In that case, A is a block-diagonal matrix; the resulting matrix equation can be partitioned into K (sub) matrix equations, one for each cluster (or submatrix block). The block-diagonal case is still $O(N^3)$, but involves fewer computations than the general case.

In general, solving an equation of the form of Equation 22 has $O(N^3)$ complexity. That is, the number of calculations required to determine the N unknown intensities scales with the cube of the number of unknown intensities.

1) Special Case: The N Signals are Superimposable by Unit Time Shifts

In this section, some additional constraints are imposed on the problem so as to provide a dramatic reduction in the complexity of solving the general case of (Equation 22). Constraint 1: any pair of signals $U_m$ and $U_n$ can be superimposed by a time-shift. Constraint 2: the time shift between adjacent signals $U_n$ and $U_{n+1}$ is the same for all n in [1 . . . N−1].

An equivalent statement of constraint (1) is that all signals can be represented by a time-shift of a canonical signal U. This constraint is applicable to the high-mass resolving power quadrupole problem. The second constraint leads to an easily determined solution for detecting signals and providing initial estimates of their positions, despite significant overlap between the signals. These two constraints reduce the solution of Equation 22 from an $O(N^3)$ problem to an $O(N^2)$ problem, as disclosed herein below.

Constraint (1) above can be represented symbolically by Equation 23.

$$U_n[v,q] = U_m[v, q+n-m] \tag{23}$$

where v is a set of indices representing the values of all independent variables except time (i.e., in this case, position in the exit cross section and initial RF phase) and q is a time index. Because the signals are related by time shifts, it becomes necessary to distinguish between time and the other independent variables affecting the observations.

For Equation 23 to be well-defined, the collection of measurements taken at any time point m must involve the same collection of values of v as at any other time point n. Taking this property into account, the definition of the inner product (Equation 5) is rewritten in terms of time values and the other independent variables.

$$a \cdot b = \sum_{q=1}^{Q} \sum_{v=1}^{V} a[v, q] b[v, q] \tag{24}$$

where the total number of measurements J=QV, q is the time index, and v is the index for remaining values (i.e., the finite number of combinations of the values of the other independent variables are enumerated by a one dimensional index v.)

In addition, because both $U_n$ and $U_m$ must be defined on the entire interval [1 . . . N], both signals must also be defined outside [1 . . . N]. A time shift of the interval [1 . . . N], or any other finite interval, would not be contained within the same interval. Therefore, all signals must be defined for all integer time points; presumably, outside some support region of finite extent, the signal value is defined to be zero.

The special property imposed by the constraints is revealed by considering the matrix entry $A_{(m+k)(n+k)}$. The short derivation below shows that one can write $A_{(m+k)(n+k)}$ in terms of $A_{mn}$, plus a term that, in many cases, are negligibly small.

$$A_{(m+k)(n+k)} = U_{m+k} \cdot U_{n+k} = \sum_{q=1}^{Q}\sum_{v=1}^{V} U_{m+k}[v, q]U_{n+k}[v, q] \tag{25}$$

$$= \sum_{q=1}^{Q}\sum_{v=1}^{V} U_m[v, q-k]U_n[v, q-k]$$

$$= \sum_{q=1}^{Q-k}\sum_{v=1}^{V} U_m[v, q]U_n[v, q]$$

$$= \sum_{q=1}^{0}\sum_{v=1}^{V} U_m[v, q]U_n[v, q] + \sum_{q=1}^{Q}\sum_{v=1}^{V} U_m[v, q]U_n[v, q] - \sum_{q=Q-k+1}^{Q}\sum_{v=1}^{V} U_m[v, q]U_n[v, q]$$

$$= A_{mn} + \left(\sum_{q=1-k}^{0}\sum_{v=1}^{V} U_m[v, q]U_n[v, q] - \sum_{q=Q-k+1}^{Q}\sum_{v=1}^{V} U_m[v, q]U_n[v, q]\right)$$

In Equation 25 above, the expression to the right of the first equals sign follows from the definition of the matrix entry (Equation 22); the next expression follows from the new inner product definition where time is distinguished from the other independent variables, (Equation 24); the next expression follows by applying the time-shift equation (Equation 23) to each factor in order to write them in terms of $U_m$ and $U_n$ respectively. The expression on the second line of Equation 25 involves replacing the summation index q by q+k. The expression on the third line of Equation 25 is the result of breaking the summation over the time index into three parts: the values of q less than 1, the values of q from 1 to Q, and then subtracting the extra terms from Q−k+1 to Q. The second of these three sums is $A_{mn}$ and this quantity is relabeled and pulled out front in the final expression.

To equate entry $A_{(m+k)(n+k)}$ with $A_{mn}$ for arbitrary values of k, one considers the term that appears in parentheses in the final expression in Equation 25 to be an error term. The error term comprises two terms referred to as "left" and "right". The "left" term is zero when either signal, $U_{m+k}$ or $U_{n+k}$, has decreased to zero before reaching the left edge of the time window where data had been collected; similarly, the "right" term is zero when either signal has decreased to zero before reaching the right edge of the data window.

When the "error" term of Equation 25 is approximated by zero, one can approximate each entry of the form $A_{(m+k)(n+k)}$ by $A_{mn}$. By definition, a matrix A that satisfies this property is a Toeplitz form, the significance of which is described herein below.

Suppose matrix A is a Toeplitz form. Then the entries along diagonal bands of the matrix are equivalent. For example, $A_{12}=A_{23}=A_{34}$ . . . In general, any entry in the matrix, e.g., $A_{mn}$, depends only upon the difference between the row index and the column index, m-n. Therefore, the N×N matrix contains only 2N−1 distinct values, corresponding to values of m-n ranging from −N to N.

Matrix A can be constructed by specifying the 2N−1 distinct values, placing the first N values in the first column of the matrix, in inverted order, i.e. from bottom to top, and then filling the remaining N−1 entries of the first row from left to right. The rest of the matrix is filled by filling each of the 2N−1 bands parallel to the main diagonal by copying the value from the left or upper edge of the matrix downward to the right until reaching the bottom or left edge respectively. When A is a Toeplitz matrix, Equation 22 can be solved by the method of Levinson recursion (e.g., see Numerical Recipes in C) requiring only $O(N^2)$ calculations. The Toeplitz property leads to relatively rapid computation of initial estimates of N intensity values.

The errors induced by the Toeplitz approximation ($A_{(m+k)(n+k)}$~$A_{mn}$) can be most easily understood when considering special cases. First, consider a diagonal matrix A. Suppose that signal $U_1$ lies entirely within the time interval [1 . . . Q] where data is observed, i.e., no truncation. Now, consider signal $U_n$, which is shifted by (n−1) time units to the right of $U_1$. Suppose that signal $U_n$ extends beyond time Q, and thus the right tail of the signal is truncated by the data window. The inner product of $U_n$ with itself, the matrix entry $A_{nn}$, is then less than $A_{11}$, as a result of the truncation. However, in the Toeplitz approximation, one equates $A_{nn}$ to $A_{11}$. The resulting overestimation of $A_{nn}$ results in underestimation of the corresponding intensity $I_n$*. Similarly, in the block-diagonal case, the intensities of signals in blocks that are truncated by the edge of the window are also underestimated. Within a block, if truncation reduces all terms by a similar scale factor, the result is to scale all intensities by the inverse of the same factor.

The collection of N estimated values at regular intervals in time (or equivalently m/z) {In*} can be interpreted as the mass spectrum reconstructed from the observed data vector X."

2) Estimation of the Number of Signals Present and their Positions

Finally, one considers how to use the initial estimates that result from solving the Toeplitz system. One does not expect that the data is, in fact, the realization of N evenly spaced signals. Rather, it is expected that the data is the realization of a relatively small number of signals (e.g. k<<N) that lie at arbitrary values of time. In this context, one expects that the majority of the N intensities results in zero. Estimated values that differ from zero may indicate the presence of a signal, but may also result from noise in the data, errors in the positions of the signals that are present, errors in the signal model, and truncation effects.

A threshold is applied to the intensity values, retaining only k signals, corresponding to distinct ion species that exceed a threshold and setting the remaining intensities to zero. The thresholded model approximates the data as the superposition of k signals. As a beneficial result for application purposes of the present invention, the solution of the Toeplitz system produces a set of intensity values that lead to the identification of the number of signals present (k) and the approximate positions of these k signals.

General Discussion of the Data Processing

The present invention is thus designed to express an observed signal as a linear combination of a mixture of reference signals. In this case, the observed "signal" is the time series of acquired images of ions exiting the quadrupole. The reference signals are the contributions to the observed signal from ions with different m/z values. The coefficients in the linear combination correspond to a mass spectrum.

Reference Signals:

To construct the mass spectrum for the present invention, it is beneficial to specify, for each m/z value, the signal, the time series of ion images that can be produced by a single species of ions with that m/z value. The approach herein is to construct a canonical reference signal, offline as a calibration step, by observing a test sample and then to express a family of reference signals, indexed by m/z value, in terms of the canonical reference signal.

At a given time, the observed exit cloud image depends upon three parameters—a and q and also the RF phase of the ions as they enter the quadrupole. The exit cloud also depends upon the distribution of ion velocities and radial displacements, with this distribution being assumed to be invariant with time, except for intensity scaling.

The construction of the family of reference signals for the present invention presents a challenge. Two of three parameters, a and q, that determine the signal depend upon the ratio t/(m/z), but the third parameter depends only on t, not on m/z. Therefore, there is no way simple way to precisely relate the time-series from a pair of ions with arbitrary distinct m/z values.

Fortunately, a countable (rather than continuous) family of reference signals can be constructed from a canonical reference signal by time shifts that are integer multiples of the RF cycle. These signals are good approximations of the expected signals for various ion species, especially when the m/z difference from the canonical signal is small.

To understand why the time-shift approximation works and to explore its limitations, consider the case of two pulses centered at $t_1$ and $t_2$ respectively and with widths of $d_1$ and $d_2$ respectively, where $t_2=kt_1$, $d_2=kt_2$, and $t_1>>d_1$. Further, assume that k is approximately 1. The second pulse can be produced from the first pulse exactly by a dilation of the time axis by factor k. However, applying a time shift of $t_2-t_1$ to the first pulse would produce a pulse centered at $t_2$ with a width of $d_1$, which is approximately equal to $d_2$ when k is approximately one. For low to moderate stability limits (e.g. 10 Da or less), the ion signals are like the pulse signals above, narrow and centered many peak widths from time zero.

Because the ion images are modulated by a fixed RF cycle, the canonical reference signal cannot be related to the signal from arbitrary m/z value by a time shift; rather, it can only be related to signals by time shifts that are integer multiples of the RF period. That is, the RF phase aligns only at integer multiples of the RF period.

The restriction that we can only consider discrete time shifts is not a serious limitation of the present invention. Even in Fourier Transform Mass Spectrometry (FTMS), where the family of reference signals is valid on the frequency continuum, the observed signal is actually expressed in terms of a countable number of sinusoids whose frequencies are integer multiples of 1/T, where T is the duration of the observed signal. In both FTMS and the present invention, expressing a signal that does not lie exactly on an integer multiple, where a reference signal is defined, results in small errors in the constructed mass spectrum. However, these errors are, in general, acceptably small. In both FTMS and in the present invention, the m/z spacing of the reference signals can be reduced by reducing the scan rate. Unlike FTMS, a reduced scan rate in the present invention does not necessarily mean a longer scan; rather, a small region of the mass range can be quickly targeted for a closer look at a slower scan rate.

Returning to the deconvolution problem stated above, it is assumed that the observed signal is the linear combination of reference signals, and it is also assumed that there is one reference signal at integer multiples of the RF period, corresponding to regularly spaced intervals of m/z. The m/z spacing corresponding to an RF cycle is determined by the scan rate.

Matrix Equation:

The construction of a mass spectrum via the present invention is conceptually the same as in FTMS. In both FTMS and as utilized herein, the sample values of the mass spectrum are the components of a vector that solves a linear matrix equation: Ax=b, as discussed in detail above. Matrix A is formed by the set of overlap sums between pairs of reference signals. Vector b is formed by the set of overlap sums between each reference signal and the observed signal. Vector x contains the set of (estimated) relative abundances.

Matrix Equation Solution:

In FTMS, matrix A is the identity matrix, leaving x=b, where b is the Fourier transform of the signal. The Fourier transform is simply the collection of overlap sums with sinusoids of varying frequencies. In the present invention, matrix A is often in a Toeplitz form, as discussed above, meaning that all elements in any band parallel to the main diagonal are the same. The Toeplitz form arises whenever the reference signals in an expansion are shifted versions of each other.

Computational Complexity:

Let N be denote the number of time samples or RF cycles in the acquisition. In general, the solution of Ax=b has $O(N^3)$ complexity, the computation of A is $O(N^3)$ and the computation of b is $O(N^2)$. Therefore, the computation of x for the general deconvolution problem is $O(N^3)$. In FTMS, A is constant, the computation of b is O(NlogN) using the Fast Fourier Transform. Because Ax=b has a trivial solution, the computation is O(NlogN). In the present invention, the computation of A is $O(N^2)$ because only 2N−1 unique values need to be calculated, the computation of B is $O(N^2)$, and the solution of Ax=b is $O(N^2)$ when A is a Toeplitz form. Therefore, the computation of x—the mass spectrum—is $O(N^2)$.

The reduced complexity, from $O(N^3)$ to $O(N^2)$ is beneficial for constructing a mass spectrum in real-time. The computations are highly parallelizable and can be implemented on an imbedded GPU. Another way to reduce the computational burden is to break the acquisition into smaller time intervals or "chunks". The solution of k chunks of size N/k results in a k-fold speed-up for an $O(N^2)$ problem. "Chunking" also addresses the problem that the time-shift approximation for specifying reference signals may not be valid for m/z values significantly different from the canonical reference signal.

Further Performance Analysis Discussion

The key metrics for assessing the performance of a mass spectrometer are sensitivity, mass resolving power, and the scan rate. As previously stated, sensitivity refers to the lowest abundance at which an ion species can be detected in the proximity of an interfering species. MRP is defined as the ratio M/DM, where M is the m/z value analyzed and DM is usually defined as the full width of the peak in m/z units, measured at half-maximum (i.e. FWHM). An alternative definition for DM is the smallest separation in m/z for which two ions can be identified as distinct. This alternative definition is most useful to the end user, but often difficult to determine In the present invention, the user can control the scan rate and the DC/RF amplitude ratio. By varying these two parameters, users can trade-off scan rate, sensitivity, and MRP, as described below. The performance of the present invention is also enhanced when the entrance beam is focused, providing greater discrimination. Further improvement, as previously stated, can be achieved by displacing a focused beam slightly off-center as it enters the quadrupole. When the ions enter off-center, the exit ion cloud undergoes larger oscillations, leading to better discrimination of closely related signals. However, it is to be noted that if the beam is too far off-center, fewer ions reach the detector resulting in a loss of sensitivity.

Scan Rate:

Scan rate is typically expressed in terms of mass per unit time, but this is only approximately correct. As U and V are ramped, increasing m/z values are swept through the point (q*,a*) lying on the operating line, as shown above in FIG. 2A. When U and V are ramped linearly in time, the value of m/z seen at the point (q*,a*) changes linearly in time, and so the constant rate of change can be referred to as the scan rate in units of Da/s. However, each point on the operating line has a different scan rate. When the mass stability limit is relatively narrow, m/z values sweep through all stable points in the operating line at roughly the same rate.

Sensitivity:

Fundamentally, the sensitivity of a quadrupole mass spectrometer is governed by the number of ions reaching the detector. When the quadrupole is scanned, the number of ions of a given species that reach the detector is determined by the product of the source brightness, the average transmission efficiency and the transmission duration of that ion species. The sensitivity can be improved, as discussed above, by reducing the DC/RF line away from the tip of the stability diagram. The average transmission efficiency increases when the DC/RF ratio because the ion spends more of its time in the interior of the stability region, away from the edges where the transmission efficiency is poor. Because the mass stability limits are wider, it takes longer for each ion to sweep through the stability region, increasing the duration of time that the ion passes through to the detector for collection.

Duty Cycle:

When acquiring a full spectrum, at any instant, only a fraction of the ions created in the source are reaching the detector; the rest are hitting the rods. The fraction of transmitted ions, for a given m/z value, is called the duty cycle. Duty cycle is a measure of efficiency of the mass spectrometer in capturing the limited source brightness. When the duty cycle is improved, the same level of sensitivity can be achieved in a shorter time, i.e. higher scan rate, thereby improving sample throughput. In a conventional system as well as the present invention, the duty cycle is the ratio of the mass stability range to the total mass range present in the sample.

By way of a non-limiting example to illustrate an improved duty cycle by use of the methods herein, a user of the present invention can, instead of 1 Da (typical of a conventional system), choose stability limits (i.e., a stability transmission window) of 10 Da (as provided herein) so as to improve the duty cycle by a factor of 10. A source brightness of $10^9$/s is also configured for purposes of illustration with a mass distribution roughly uniform from 0 to 1000, so that a 10 Da window represents 1% of the ions. Therefore, the duty cycle improves from 0.1% to 1%. If the average ion transmission efficiency improves from 25% to nearly 100%, then the ion intensity averaged over a full scan increases 40-fold from $10^9/s*10^{-3}*0.25=2.5*10^5$ to $10^9/s*10^{-2}*1=10^7/s$.

Therefore, suppose a user of the present invention desires to record 10 ions of an analyte in full-scan mode, wherein the analyte has an abundance of 1 ppm in a sample and the analyte is enriched by a factor of 100 using, for example, chromatography (e.g., 30-second wide elution profiles in a 50-minute gradient). The intensity of analyte ions in a conventional system using the numbers above is $2.5*10^5*10^{-6}*10^2=250/s$. So the required acquisition time in this example is about 40 ms. In the present invention, the ion intensity is about 40 times greater when using an example 10 Da transmission window, so the required acquisition time in the system described herein is at a remarkable scan rate of about 1 ms.

Accordingly, it is to be appreciated the beneficial sensitivity gain of the present invention as opposed to a conventional system comes from pushing the operating line downward away from the tip of the stability region, as discussed throughout above, and thus widening the stability limits. In practice, the operating line can be configured to go down as far as possible to the extent that a user can still resolve a time shift of one RF cycle. In this case, there is no loss of mass resolving power; it achieves the quantum limit.

As described above, the present invention can resolve time-shifts along the operating line to the nearest RF cycle. This RF cycle limit establishes the tradeoff between scan rate and MRP, but does not place an absolute limit on MRP and mass precision. The scan rate can be decreased so that a time shift of one RF cycle along the operating line corresponds to an arbitrarily small mass difference.

For example, suppose that the RF frequency is at about 1 MHz. Then, one RF period is 1 us. For a scan rate of 10 kDa/s, 10 mDa of m/z range sweeps through a point on the operating line. The ability to resolve a mass difference of 10 mDa corresponds to a MRP of 100 k at m/z 1000. For a mass range of 1000 Da, scanning at 10 kDa/s produces a mass spectrum in 100 ms, corresponding to a 10 Hz repeat rate, excluding interscan overhead. Similarly, the present invention can trade off a factor of x in scan rate for a factor of x in MRP. Accordingly, the present invention can be configured to operate at 100 k MRP at 10 Hz repeat rate, "slow" scans at 1M MRP at 1 Hz repeat rate, or "fast" scans at 10 k MRP at 100 Hz repeat rate. In practice, the range of achievable scan speeds may be limited by other considerations such as sensitivity or electronic stability.

Exemplary Modes of Operation

As one embodiment, the present invention can be operated in $MS^1$ "full scan" mode, in which an entire mass spectrum is acquired, e.g., a mass range of 1000 Da or more. In such a configuration, the scan rate can be reduced to enhance sensitivity and mass resolving power (MRP) or increased to improve throughput. Because the present invention provides for high MRP at relatively high scan rates, it is possible that scan rates are limited by the time required to collect enough ions, despite the improvement in duty cycle provided by present invention over conventional methods and instruments.

As another embodiment, the present invention can also be operated in a "selected ion mode" (SIM) in which one or more selected ions are targeted for analysis. Conventionally, a SIM mode, as stated previously, is performed by parking the quadrupole, i.e. holding U and V fixed. By contrast, the present invention scans U and V rapidly over a narrow mass range, and using wide enough stability limits so that transmission is about 100%. In selected ion mode, sensitivity requirements often dictate the length of the scan. In such a case, a very slow scan rate over a small m/z range can be chosen to maximize MRP. Alternatively, the ions can be scanned over a larger m/z range, i.e. from one stability boundary to the other, to provide a robust estimate of the position of the selected ion.

As also stated previously, hybrid modes of $MS^1$ operation can be implemented in which a survey scan for detection across the entire mass spectrum is followed by multiple target scans to hone in on features of interest. Target scans can be used to search for interfering species and/or improve quantification of selected species. Another possible use of the target scan is elemental composition determination. For example, the quadrupole of the present invention can target the "A1" region, approximately one Dalton above the monoisotopic ion species to characterize the isotopic distribution. For example, with an MRP of 160 k at m/z 1000, it is possible to resolve C-13 and N-15 peaks, separated by 6.3 mDa. The abundances of these ions provide an estimate of the number of carbons and nitrogens in the species. Similarly, the A2 isotopic species can be probed, focusing on the C-$13_2$, S-34 and O-18 species.

In a triple quadrupole configuration, the position-sensitive detector used in the present invention, as described above, can be placed at the exit of Q3. The other two quadrupoles, Q1 and Q2, are operated in a conventional manner, i.e., as a precursor mass filter and collision cell, respectively. To collect $MS^1$ spectra, Q1 and Q2 allow ions to pass through without mass filtering or collision. To collect and analyze product ions, Q1 can be configured to select a narrow range of precursor ions (i.e. 1 Da wide mass range), with Q2 configured to fragment the ions, and Q3 configured to analyze the product ions.

Q3 can also be used in full-scan mode to collect (full) MS/MS spectra at 100 Hz with 10 k MRP at m/z 1000, assuming that the source brightness is sufficient to achieve acceptable sensitivity for 1 ms acquisition. Alternatively, Q3 can be used in SIM mode to analyze one or more selected product ions, i.e., single reaction monitoring (SRM) or multiple reaction monitoring (MRM). Sensitivity can be improved by focusing the quadrupole on selected ions, rather than covering the whole mass range.

Simulated Results

Figure 7:
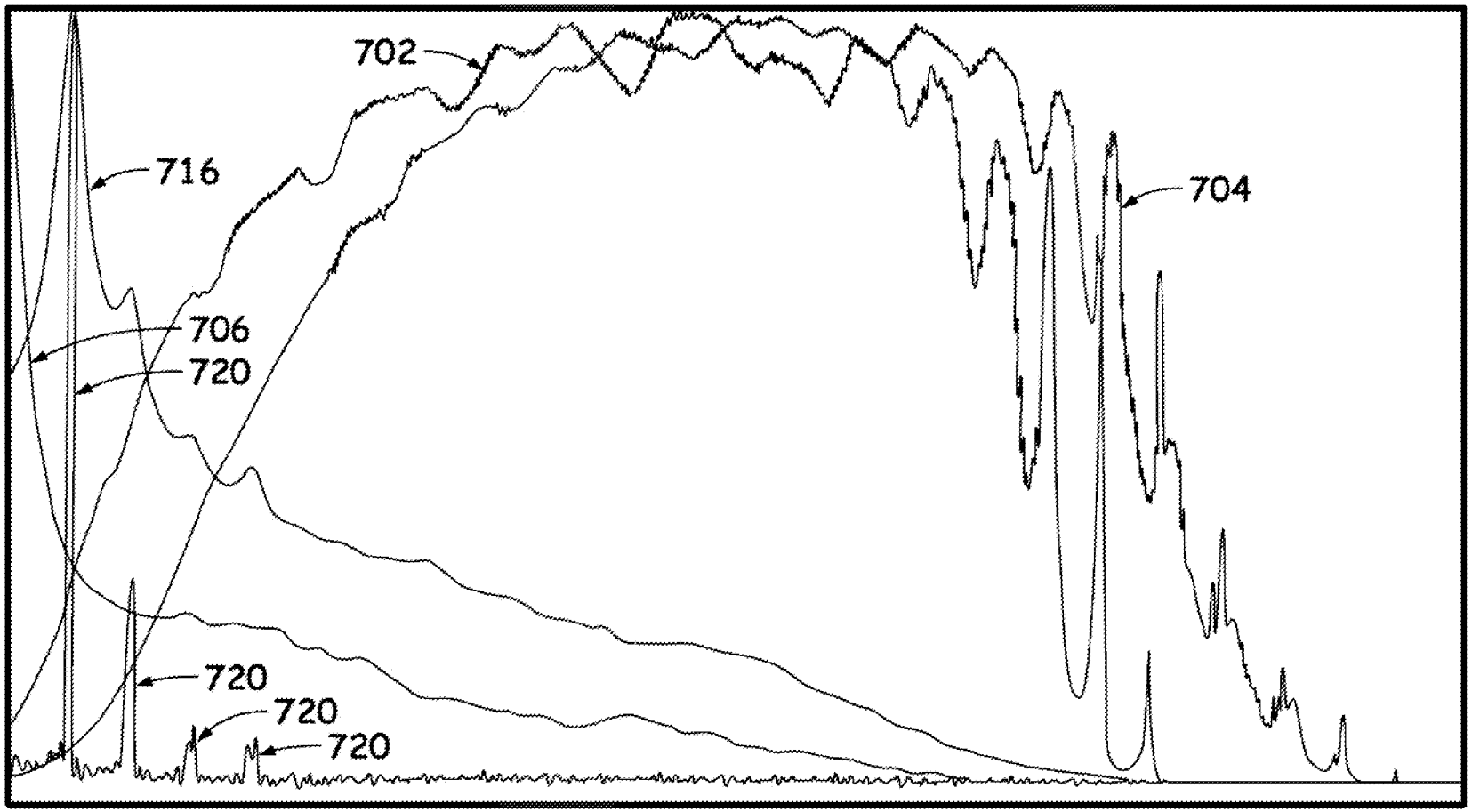
FIG. 7 illustrates an example simulated result of the deconvolution process of the present invention.

FIG. 7 illustrates an example simulated result of the deconvolution process detailed above upon being provided a recorded image (e.g., FIG. 2B) using embodiments described herein. The present invention first acquires or synthetically generates a reference signal 702. Thereafter the process is designed to acquire convolved raw data 704 of desired analyte ions as provided by the recorded data. The data for such a process is acquired in three dimensional packets or voxels (i.e., volumetric pixels) where two dimensions are the image X and Y that correspond to the ion exit pattern collected by a positioned detector described above. The third dimension is time corresponding and synchronized to the phase of the containing RF. The process then generates a shifted autocorrelation vector 706 from the reference signal 702 and breaks the acquired data into suitable chunks (clips portions of data if too voluminous) and pads such data with zeros. An important part of the method as embodied by equation 22 of the deconvolution process, as shown above, includes the shifted cross correlation between the reference signal 702 and the chunked acquired raw data 704 to provide the cross correlation trace denoted by 716. Thereafter, a number of intensity peaks 720 are extracted from the Toeplitz solution (e.g., $I_n^*=a_n/A_{nn}$), which indicate how many peaks exist, relative accurate intensities, and where their approximate positions are located. In this example, the desired intensity peaks 720 are shown as being evenly spaced at mass intervals defined in units of ppm with relative intensities 1, ¼, 1/16, and 1/64. Then, a four by four version of the problem is produced with interpolated shifted cross and autocorrelation dot products. Subsequently, the intensity estimate is refined with a constrained form of the problem and iteratively refined to include data filtering (e.g., using Bessel filtering) as required. Any chunked data resulting from a voluminous data set can thereafter be recombined so as to provide the full spectrum originally recorded.

Figure 8:
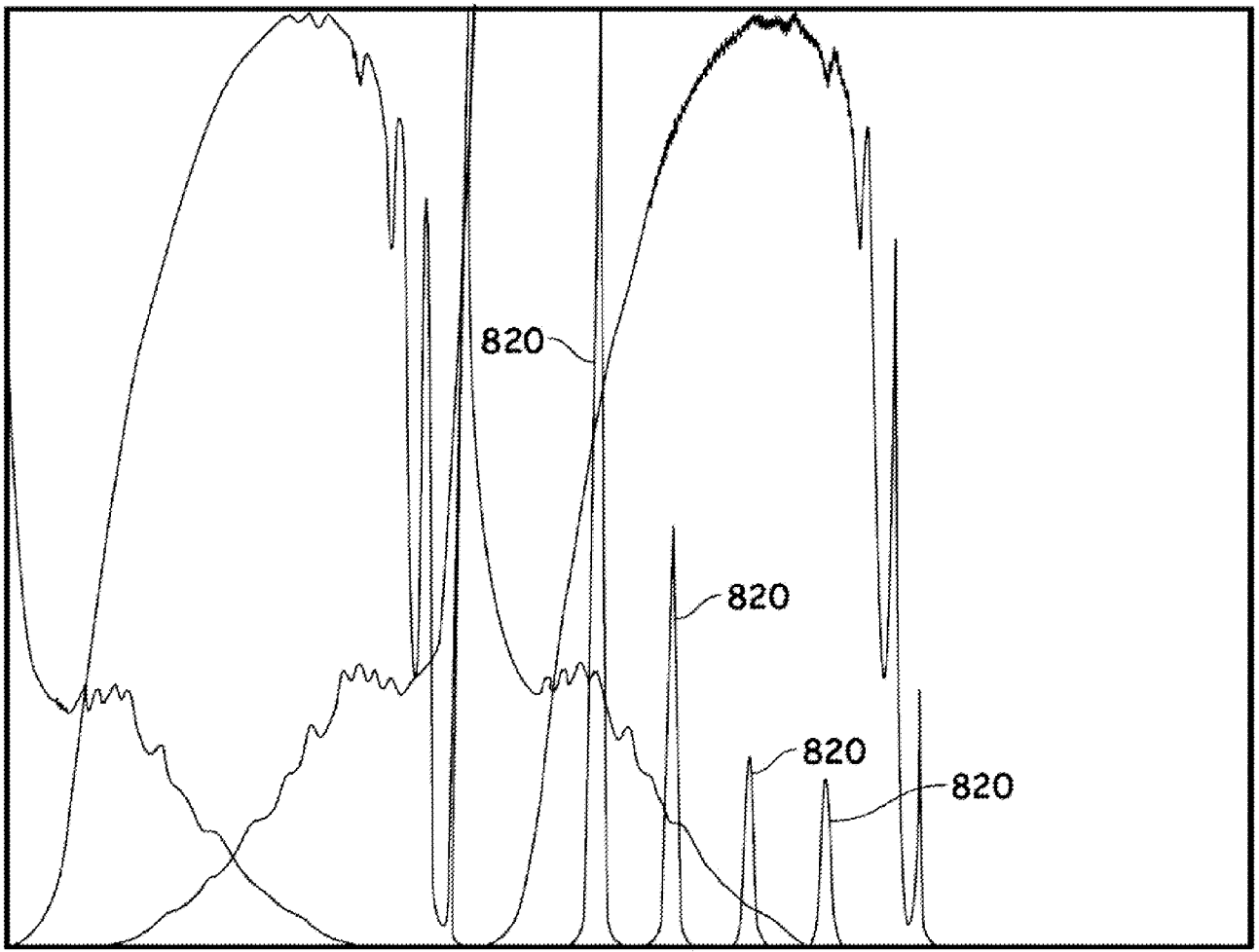
FIG. 8 shows an example simulated result of the deconvolution process having a mass resolving power measured at FWHM.

FIG. 8 shows resultant data is for a cluster of four peaks 820, wherein the centers of the tallest peak and the second tallest peak are separated by 7 peak widths, which corresponds to 10 ppm, resulting in a surprising mass resolving power of $7*1e^6/10=700$ k.

It is to be understood that features described with regard to the various embodiments herein may be mixed and matched in any combination without departing from the spirit and scope of the invention. Although different selected embodiments have been illustrated and described in detail, it is to be appreciated that they are exemplary, and that a variety of substitutions and alterations are possible without departing from the spirit and scope of the present invention.

The invention claimed is:

1. A method of analyzing a sample by mass spectrometry, comprising the steps of:

generating a stream of ions from the sample;

delivering the ions to the inlet end of a multipole, the multipole defining a central longitudinal axis and first and second transverse axes;

generating an electric field within the multipole, the electric field causing a subset of ions having a range of mass-to-charge values (m/z's) to be selectively transmitted to a distal end of the multipole along the central longitudinal axis, the range of m/z's of the transmitted ions being determined by at least one parameter of the electric field;

progressively varying the at least one parameter of the electric field;

acquiring a series of temporally-resolved ion images of ions selectively transmitted to the distal end of the multipole while the at least one parameter of the electric field is varied, each ion image containing information regarding the intensities of ions sensed at different locations on at least one transverse axis; and deconvolving data in the series of ion images to produce a mass spectrum.

2. The method of claim 1, wherein the multipole is a quadrupole.

3. The method of claim 2, wherein the step of generating the electric field comprises applying oscillatory and direct current (DC) voltages to electrodes of the quadrupole, and the step of progressively varying the at least one parameter of the electric field includes varying the amplitude of at least one of the applied oscillatory and DC voltages.

4. The method of claim 1, wherein the range of m/z's of ions selectively transmitted to the distal end of the multipole is between 2 and 20 amu.

5. The method of claim 1, wherein the step of acquiring a series of ion images is performed using a two-dimensional detector, and wherein each ion image contains information regarding the intensities of ions sensed at different locations of the first and second transverse axes.

6. The method of claim 1, wherein the step of deconvolving data in the series of ion images includes computing cross-products with a set of reference signals, each being representative of the measured or expected spatial distribution of a single ion species at a particular operating state of the multipole.

7. The method of claim 1, wherein the step of delivering ions to the inlet end of the multipole comprises fragmenting the ions to yield product ions.

8. The method of claim 7, wherein the step of fragmenting the ions includes mass selecting a subset of ions prior to fragmentation.

9. The method of claim 1, wherein the step of delivering ions to the inlet end of the quadrupole includes injecting the ions into the inlet end at an axis that is angularly offset with respect to the central longitudinal axis of the multipole.

* * * * *